US007896477B2

(12) United States Patent
Sugahara

(10) Patent No.: US 7,896,477 B2
(45) Date of Patent: Mar. 1, 2011

(54) LIQUID TRANSPORT APPARATUS AND METHOD FOR PRODUCING LIQUID TRANSPORT APPARATUS

(75) Inventor: Hiroto Sugahara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 480 days.

(21) Appl. No.: 12/022,355

(22) Filed: Jan. 30, 2008

(65) Prior Publication Data

US 2008/0180491 A1 Jul. 31, 2008

(30) Foreign Application Priority Data

Jan. 30, 2007 (JP) ..... 2007-019767

(51) Int. Cl.
*B41J 2/045* (2006.01)

(52) U.S. Cl. ..... 347/68

(58) Field of Classification Search ..... 347/70, 347/68–69, 71–72; 400/124.14, 124.16; 310/311, 324; 29/25.35, 890.1
See application file for complete search history.

(56) References Cited

U.S. PATENT DOCUMENTS 5,215,446 A 6/1993 Takahashi et al.
2005/0123420 A1 6/2005 Richter et al.
2005/0196958 A1 9/2005 Nihei et al.

FOREIGN PATENT DOCUMENTS

| | | | |
|---|---|---|---|
| EP | 0949418 | A2 | 10/1999 |
| JP | 64032077 | A | 2/1989 |
| JP | H02-149778 | A | 6/1990 |
| JP | 4191480 | B2 | 7/1992 |
| JP | 6147104 | A | 5/1994 |

OTHER PUBLICATIONS

European Patent Office; European Search Report in European Patent Application No. 08001538.1 (counterpart to the above-captioned U.S. patent application) mailed Jan. 29, 2010.

*Primary Examiner*—K. Feggins
(74) *Attorney, Agent, or Firm*—Baker Botts L.L.P.

(57) ABSTRACT

A liquid transport apparatus includes a base member having a surface in which a pressure chamber and a liquid flow passage are formed, the liquid flow passage being communicated with the pressure chamber and having a flow passage cross-sectional area smaller than that of the pressure chamber and a piezoelectric actuator having a pressure-applying portion which applies a pressure to a liquid in the pressure chamber and an opening/closing portion which opens and closes the liquid flow passage. The pressure-applying portion faces the pressure chamber, the opening/closing portion faces the liquid flow passage, and the pressure-applying portion and the opening/closing portion are arranged along the surface of the base member.

14 Claims, 26 Drawing Sheets

LIQUID TRANSPORT APPARATUS AND METHOD FOR PRODUCING LIQUID TRANSPORT APPARATUS

CROSS REFERENCE TO RELATED APPLICATION

The present application claims priority from Japanese Patent Application No. 2007-019767, filed on Jan. 30, 2007, the disclosure of which is incorporated herein by reference in its entirety.

BACKGROUND OF THE INVENTION

1. Field of the Invention

The present invention relates to a liquid transport apparatus which transports a liquid, and a method for producing the liquid transport apparatus.

2. Description of the Related Art

A liquid transport apparatus (piezoelectric pump) has been hitherto known, which transports a liquid by applying the pressure to the liquid by utilizing the deformation of a piezoelectric element brought about when a voltage (electric field) is applied. For example, a piezoelectric pump, which is described in Japanese Patent Application Laid-open No. 6-147104, is provided with two pump chambers which have same shape (circular shape) and which are communicated with each other, a pressure-adjusting chamber which is communicated with the pump chamber disposed on the downstream side and which has the same shape as that of the pump chamber, and piezoelectric elements which are arranged to cover the two pump chambers from upper and lower portions respectively. A voltage is applied to the piezoelectric element corresponding to each of the pump chambers to cause the deformation so that the volume of the pump chamber is changed. Accordingly, the pressure is applied to the liquid contained in the pump chamber, and thus the liquid is transported. Thin films are arranged at upper and lower positions with respect to the pressure-adjusting chamber. The pressure of the liquid fed from the pump chamber is adjusted in the pressure-adjusting chamber by means of the elastic deformation of the thin films.

A piezoelectric pump described in Japanese Patent Application Laid-open No. 64-32077 (FIG. 2) is provided with a pump chamber, a liquid supply passage and a liquid discharge passage which are communicated with the pump chamber, and three piezoelectric transducers or oscillators (first, second, and third piezoelectric transducers) which are provided corresponding to the pump chamber, the liquid supply passage, and the liquid discharge passage respectively. The first piezoelectric transducer, which corresponds to the pump chamber, is arranged to cover the pump chamber. The volume of the pump chamber is changed in accordance with the deformation thereof to apply the pressure to the liquid in the pump chamber. On the other hand, the second and third piezoelectric transducers are provided at intermediate portions of the liquid supply passage and the liquid discharge passage respectively. The liquid supply passage and the liquid discharge passage are opened and closed in accordance with their own deformation. In this case, the liquid supply passage and the liquid discharge passage extend from the side wall of the pump chamber in the horizontal direction perpendicular to the side wall. Therefore, the piezoelectric pump described in Japanese Patent Application Laid-open No. 64-32077 has such a three-dimensional structure that the first piezoelectric transducer which is provided to apply the pressure to the liquid in the pump chamber and the second and third piezoelectric transducers which open and close the liquid supply passage and the liquid discharge passage respectively are positioned on mutually different planes.

The piezoelectric pump described in Japanese Patent Application Laid-open No. 6-147104 is not provided with any means for closing the flow passage disposed on the upstream side of the pump chamber when the piezoelectric element is deformed to apply the pressure to the liquid in the pump chamber. For this reason, even when the pressure is applied to the liquid in the pump chamber, a part of the pressure wave escapes toward the upstream side. Therefore, the transport efficiency is unsatisfactory. A valve mechanism for opening/closing the flow passage disposed on the upstream side of the pump chamber can be provided distinctly from the piezoelectric pump. However, the number of parts is increased, and the structure is complicated as well, which is disadvantageous in view of the production cost.

In the case of the piezoelectric pump described in Japanese Patent Application Laid-open No. 64-32077, the first piezoelectric transducer for applying the pressure to the liquid in the pump chamber and the second and third piezoelectric transducers for opening/closing the liquid supply passage and the liquid discharge passage are not arranged on the same plane. For this reason, the structure of the piezoelectric pump is complicated, and it is difficult to miniaturize the pump. Further, when the pump is produced, it is necessary that the first piezoelectric transducer and the second and third piezoelectric transducers should be arranged in separate steps. The number of steps is increased, and the production cost is increased corresponding thereto.

SUMMARY OF THE INVENTION

An object of the present invention is to provide a liquid transport apparatus which makes it possible to transport the liquid efficiently, which has a simple structure, and which is produced with ease as well.

According to a first aspect of the present invention, there is provided a liquid transport apparatus including: a base member having a surface in which a pressure chamber and a liquid flow passage are formed, the liquid flow passage being communicated with the pressure chamber and having a flow passage cross-sectional area smaller than that of the pressure chamber; and a piezoelectric actuator having a pressure-applying portion which applies a pressure to a liquid in the pressure chamber and an opening/closing portion which opens and closes the liquid flow passage, the piezoelectric actuator being formed of a stack including: a vibration plate which is arranged on the surface of the base member and which covers both the pressure chamber and the liquid flow passage; a piezoelectric material layer which is arranged on a surface, of the vibration plate, on a side not facing the base member; a first electrode which is arranged, on one of surfaces of the piezoelectric material layer, at an area thereof corresponding to the pressure chamber; a second electrode which is arranged, on one of the surfaces of the piezoelectric material layer, at an area thereof corresponding to the liquid flow passage; and a third electrode which is arranged on the piezoelectric material layer to face the first electrode and the second electrode, wherein the pressure-applying portion faces the pressure chamber, the opening/closing portion faces the liquid flow passage, and the pressure-applying portion and the opening/closing portion are arranged along the surface of the base member.

In the liquid transport apparatus according to the first aspect of the present invention, the pressure-applying portion of the piezoelectric actuator deforms a vibration plate portion which covers the pressure chamber in response to the deformation of the piezoelectric material layer brought about when the difference in electric potential is generated between the first electrode and the third electrode. Accordingly, the volume of the pressure chamber is changed, and the pressure is applied to the liquid therein. Further, the opening/closing portion deforms the vibration plate portion which covers the liquid flow passage so that the liquid flow passage is opened/closed in response to the deformation of the piezoelectric material layer brought about when the difference in electric potential is generated between the second electrode and the third electrode. Therefore, it is possible to efficiently transport the liquid by applying the pressure to the liquid in the pressure chamber at the appropriate timing by the pressure-applying portion while opening and closing the liquid flow passage by the opening/closing portion. No sliding portion is present in the piezoelectric actuator unlike any mechanical pump (for example, a tube pump and a syringe pump) which has been hitherto widely used as a liquid transport pump. Therefore, an advantage is also obtained such that the noise, which is generated during the operation, is small.

The piezoelectric actuator further has the stack which includes, for example, the electrodes, the piezoelectric material layer, and the vibration plate extending along one surface of the base member. The portion of the stack, which faces the pressure chamber, is the pressure-applying portion. The portion of the stack, which faces the liquid flow passage, is the opening/closing portion. The pressure-applying portion and the opening/closing portion are arranged on the same plane along one surface of the base member. Therefore, the structure of the piezoelectric actuator is simplified, the piezoelectric actuator is made compact, and thus the liquid transport apparatus can be miniaturized. Further, the pressure-applying portion and the opening/closing portion can be produced simultaneously by stacking a plurality of layers including, for example, the vibration plate and the piezoelectric material layer on one surface of the base member. Therefore, it is also possible to simplify the production steps.

It is preferable that the pressure chamber has a large flow passage cross-sectional area (cross-sectional area in the cross section perpendicular to the liquid transport direction) to a certain degree so that the volume change, which is brought about when the pressure is applied to the liquid, is increased to successfully apply the large pressure at once to the liquid therein. On the other hand, it is preferable that the liquid flow passage has a small flow passage cross-sectional area to such an extent that the flow passage resistance is not excessively increased so that the substantially complete closing can be easily realized by the deformation of the piezoelectric material layer corresponding to the opening/closing portion. In consideration of the foregoing viewpoint, in the liquid transport apparatus of the present invention, the flow passage cross-sectional area of the liquid flow passage to be opened and closed by the opening/closing portion is smaller than the flow passage cross-sectional area of the pressure chamber.

In the liquid transport apparatus of the present invention, a low rigidity portion, at which rigidity of the stack is locally lowered, may be provided between the pressure-applying portion and the opening/closing portion. When the low rigidity section is provided, it is possible to suppress the mutual interference of the deformation of the piezoelectric material layer and the vibration plate between the pressure-applying portion and the opening/closing portion.

In the liquid transport apparatus of the present invention, the low rigidity portion may be a recess formed in the vibration plate at an area thereof facing a boundary between the pressure chamber and the liquid flow passage. When the recess is formed, the thickness of the vibration plate is locally thinned in the area facing the boundary between the pressure chamber and the liquid flow passage. Therefore, the rigidity of the stack is lowered.

In the liquid transport apparatus of the present invention, the recess may be formed on the surface, of the vibration plate, on the side not facing the base member. According to this arrangement, when the piezoelectric actuator is produced, a plurality of steps (including, for example, the formation of the recess of the vibration plate and the formation of the piezoelectric material layer), which are applied to the vibration plate, can be executed in the same direction (direction opposite to the base member). Therefore, the piezoelectric actuator is easily produced. Further, it is possible to shorten the steps. Further, the problem, in which any bubble stays in the recess when the liquid is contaminated with the bubble, is not caused unlike the case in which the recess is formed on the surface of the vibration plate on the side of the base member to make contact with the liquid.

In the liquid transport apparatus of the present invention, the low rigidity portion may be a recess or a through-hole formed, in the piezoelectric material layer, at an area thereof facing a boundary between the pressure chamber and the liquid flow passage. When the recess or the through-hole is formed for the piezoelectric material layer, the rigidity of the stack is locally lowered in the area facing the boundary between the pressure chamber and the liquid flow passage.

In the liquid transport apparatus of the present invention, a flow passage width of the pressure chamber may be greater than a flow passage width of the liquid flow passage. In order to make the flow passage cross-sectional area of the pressure chamber to be greater than the flow passage cross-sectional area of the liquid flow passage, it is appropriate to increase the flow passage width or the flow passage depth. However, the area of the vibration plate, which faces the pressure chamber, is rather widened when the flow passage width is large as in the present invention. Therefore, this arrangement is preferred in view of the fact that the volume change of the pressure chamber can be increased when the pressure is applied.

The liquid transport apparatus of the present invention may further include a driver which is connected to the first electrode and the second electrode via independent wirings respectively, and the driver may independently drive the pressure-applying portion and the opening/closing portion by applying a predetermined electric potential to each of the first electrode and the second electrode at a predetermined timing. When the pressure-applying portion and the opening/closing portion are independently driven by the driver at the appropriate timings respectively, the liquid can be transported by efficiently applying the pressure.

In the liquid transport apparatus of the present invention, the predetermined electric potential may include first and second predetermined electric potentials which are mutually different; when the first predetermined electric potential is applied from the driver to the second electrode, the vibration plate may be parallel to the surface of the base member at the opening/closing portion, and when the second predetermined electric potential is applied to the second electrode, the vibration plate may be deformed to project toward the base member at the opening/closing portion; and a recessed valve seat, which is adapted to projection deformation of the vibration plate toward the base member, may be formed in the liquid flow passage of the base member, and when the vibration plate is deformed to project toward the base member to abut against the recessed valve seat, the liquid flow passage may be closed. According to this arrangement, the vibration plate is parallel to one surface of the base member when the first electric potential is applied to the second electrode of the opening/closing portion. Therefore, the gap is formed between the vibration plate and the recessed valve seat, and the liquid flow passage is in the open state. On the other hand, when the second electric potential is applied to the second electrode, and the vibration plate is deformed to project toward the base member, then the vibration plate, which has been deformed to project toward the base member, abuts against the recessed valve seat corresponding to the projection deformation to effect the adhesion or tight contact. Therefore, the liquid flow passage is reliably closed.

In the liquid transport apparatus of the present invention, the second electrode may be arranged, on the surface of the piezoelectric layer disposed on a side not facing the base member, at an area thereof facing a central portion in a widthwise direction of the liquid flow passage. According to this arrangement, when the second electric potential is applied to the second electrode facing the central portion of the liquid flow passage in the widthwise direction, the piezoelectric material layer, which is disposed in the area facing the central portion of the liquid flow passage interposed between the second electrode and the third electrode, is shrunk in the in-plane direction. Therefore, the vibration plate is deformed to project toward the base member.

In the liquid transport apparatus of the present invention, the predetermined electric potential may include first and second predetermined electric potentials which are mutually different; when the first predetermined electric potential is applied from the driver to the second electrode, the vibration plate may be parallel to the surface of the base member at the opening/closing portion, and when the second predetermined electric potential is applied to the second electrode, the vibration plate may be deformed to project toward a side not facing the base member at the opening/closing portion; and the liquid flow passage of the base member may have a dam-shaped valve seat, which extends entirely over the liquid flow passage in a widthwise direction and which has a top surface positioned in a plane same as that of the surface of the base member, and when the vibration plate is deformed to project toward the side not facing the base member, a gap may be formed between the vibration plate and the top surface of the valve seat to open the liquid flow passage. According to this arrangement, the vibration plate is parallel to one surface of the base member when the first electric potential is applied to the second electrode of the opening/closing portion. Therefore, the vibration plate abuts against the top surface of the dam-shaped valve seat positioned in the same plane as that of one surface of the base member, and the liquid flow passage is reliably closed. On the other hand, when the second electric potential is applied to the second electrode, and the vibration plate is deformed to project toward the side opposite to the base member, then the gap is formed between the vibration plate and the top of the valve seat, and the liquid flow passage is opened.

In the liquid transport apparatus of the present invention, the second electrode may include two second-electrode portions arranged, on the surface of the piezoelectric material layer on the side not facing the base member, at areas thereof respectively, the areas facing both ends in a widthwise direction of the liquid flow passage respectively. According to this arrangement, when the second electric potential is applied to the two second electrodes facing the both ends of the liquid flow passage in the widthwise direction respectively, the piezoelectric material layer portions, which are disposed in the areas facing the both ends in the widthwise direction of the liquid flow passage interposed between the two second electrodes and the third electrode, are shrunk in the in-plane direction respectively. Accordingly, the vibration plate portion, which is disposed in the area facing the central portion in the widthwise direction of the liquid flow passage, is deformed to project toward the side opposite to the base member.

In the liquid transport apparatus of the present invention, the first electrode and the second electrode may be arranged on one of the surfaces of the piezoelectric material layer, and the third electrode may be arranged on the other of the surfaces of the piezoelectric material layer. According to this arrangement, the third electrode, which corresponds to the first electrode and the second electrode respectively, is arranged on the same surface. Therefore, the third electrode can be arranged commonly for the pressure-applying portion and opening/closing portion.

In the liquid transport apparatus of the present invention, in the piezoelectric actuator, the opening/closing portion may include first and second opening/closing portions; the first opening/closing portion may open and close an upstream portion of the liquid flow passage located at an upstream side in a liquid transport direction with respect to the pressure chamber and the second opening/closing portion may open and close a downstream portion of the liquid flow passage located at a downstream side in the liquid transport direction with respect to the pressure chamber. When the two opening/closing portions are provided, the liquid flow passage can be closed on the upstream side and the downstream side of the pressure chamber respectively. Therefore, the pressure can be applied efficiently to the liquid in the pressure chamber.

According to a second aspect of the present invention, there is provided a method for producing a liquid transport apparatus, including: forming, on a surface of a base member, a pressure chamber, and a liquid flow passage which is communicated with the pressure chamber and which has a flow passage cross-sectional area smaller than that of the pressure chamber; and producing a piezoelectric actuator arranged on the surface of the base member and including a pressure-applying portion which applies a pressure to a liquid in the pressure chamber, and an opening/closing portion which opens and closes the liquid flow passages, wherein, the production of the piezoelectric actuator includes: forming a piezoelectric material layer on a side of a vibration plate, not facing the base member, the vibration plate being joined to the surface of the base member to cover both the pressure chamber and the liquid flow passage; and arranging, on a surface of the piezoelectric material layer, a first electrode and a second electrode at areas thereof respectively, the surface facing the pressure chamber and the liquid flow passage; and the formation of the piezoelectric material layer includes depositing particles of a piezoelectric material to simultaneously form the piezoelectric material layer, of the pressure-applying portion, facing the pressure chamber and the piezoelectric material layer, of the opening/closing portion, facing the liquid flow passage.

In the production method according to the second aspect of the present invention, the particles of the piezoelectric material are deposited on the surface of the vibration plate when the piezoelectric material layer is formed. Accordingly, it is possible to simultaneously form the piezoelectric material layer corresponding to the pressure-applying portion and the opening/closing portion on the vibration plate. Therefore, it is possible to simplify the production steps of the piezoelectric actuator.

The method for producing the liquid transport apparatus of the present invention may further include joining the base member and the piezoelectric actuator.

In the method for producing the liquid transport apparatus of the present invention, the vibration plate may be conductive.

In the method for producing the liquid transport apparatus of the present invention, the production of the piezoelectric actuator may include, before forming the piezoelectric material layer, arranging a third electrode on a surface of the vibration plate, on the side not facing the base member so that the third electrode corresponds to the pressure chamber and the liquid flow passage.

BRIEF DESCRIPTION OF THE DRAWINGS

FIGS. 10A to 10F illustrate the operation of the pump, wherein FIG. 10A shows a state in which the pump is stopped, FIG. 10B shows a state immediately before the pressure is applied to the ink, FIG. 10C shows a state in which the ink applied with the pressure is discharged from the pressure chamber, FIG. 10D shows a state in which the discharge of the ink is completed, FIG. 10E shows a state immediately before the ink is sucked into the pressure chamber, and FIG. 10F shows a state in which the ink is sucked into the pressure chamber.

FIGS. 11A to 11F show steps of producing the pump, wherein FIG. 11A shows a step of forming the flow passage, FIG. 11B shows a step of forming the recess of the vibration plate, FIG. 11C shows a step of forming the piezoelectric material layer, FIG. 11D shows a step of removing the piezoelectric material from the surface of the recess, FIG. 11E shows a step of arranging the electrodes, and FIG. 11F shows a step of joining the base member and the piezoelectric actuator.

DESCRIPTION OF THE PREFERRED EMBODIMENTS

An embodiment of the present invention will be explained. This embodiment is an example in which the present invention is applied to a pump for transporting an ink to an ink-jet head of an ink-jet printer.

Figure 1:
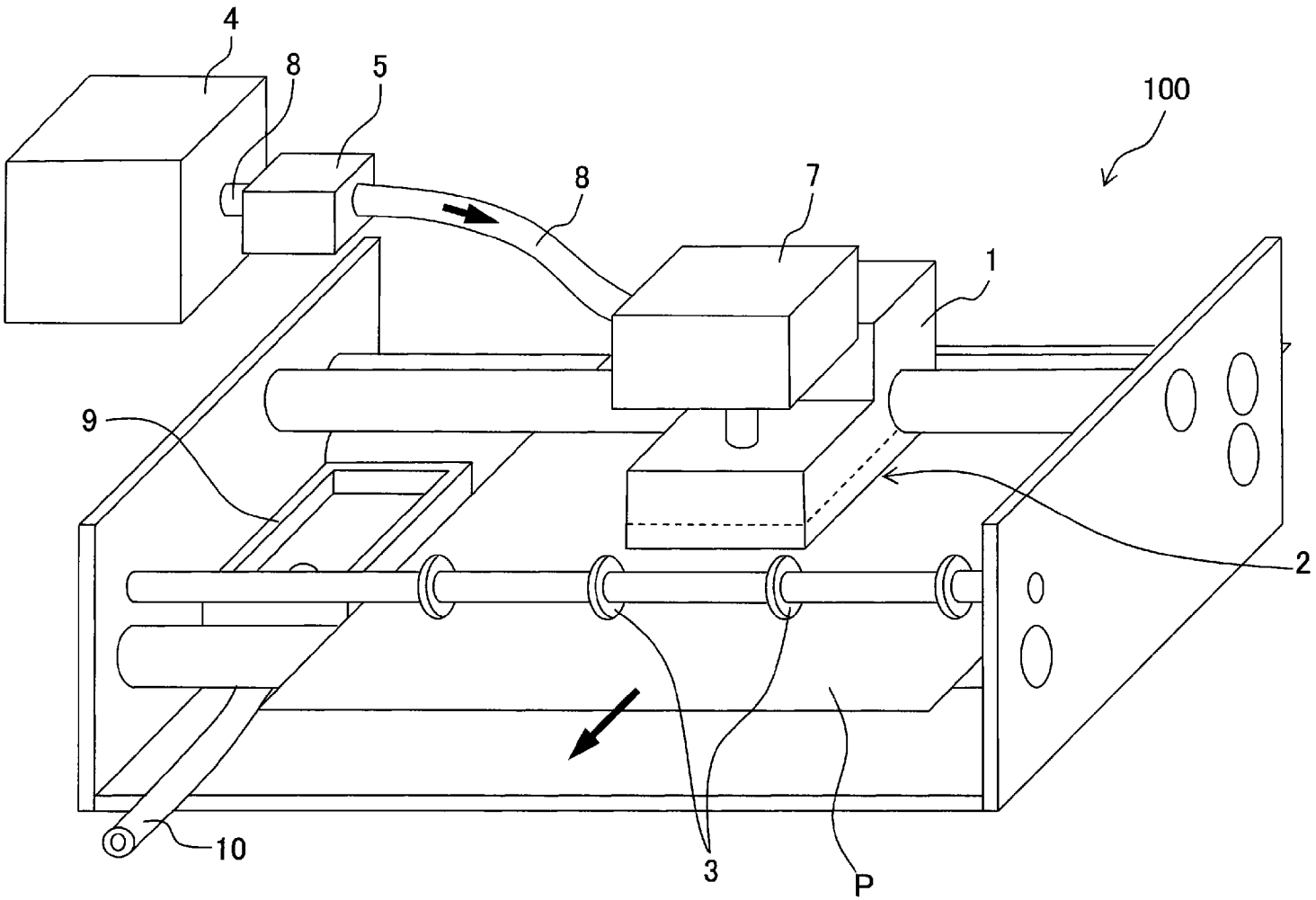
FIG. 1 shows a schematic arrangement illustrating an ink-jet printer according to an embodiment of the present invention.

At first, the ink-jet printer 100 of this embodiment will be briefly explained. As shown in FIG. 1, the ink-jet printer 100 is provided with, for example, a carriage 1 which is movable in the left-right direction in FIG. 1, a serial type ink-jet head 2 which is provided on the carriage 1 and which jets the ink toward the recording paper P, transport rollers 3 which transport the recording paper P in the frontward direction in FIG. 1, an ink tank 4 which stores the ink, a pump 5 which supplies the ink in the ink tank 4 to the ink-jet head 2, and a controller 6 (see FIG. 9) which controls respective parts of the printer 100 including, for example, the ink-jet head 2 and the transport rollers 3.

An ink subtank 7, which is movable in the scanning direction together with the carriage 1, is arranged over or above the ink-jet head 2. Further, the ink subtank 7 is connected to the ink tank 4 via a tube 8 and the pump 5. The ink, which is stored in the ink tank 4, is pressurized by the pump 5, and the ink is transported to the ink subtank 7 via the tube 8. The ink is once stored in the ink subtank 7, and then the ink is supplied to the ink-jet head 2.

The ink, which is supplied from the ink subtank 7, is jetted by the ink-jet head 2 toward the recording paper P from nozzles (not shown) arranged on the lower surface of the ink-jet head 2, while the ink-jet head 2 is moved in the left-right direction as shown in FIG. 1 together with the carriage 1. The transport rollers 3 transport the recording paper P in the frontward direction as shown in FIG. 1. The ink-jet printer 100 is constructed such that the transport rollers 3 are controlled to transport the recording paper P in the frontward direction while jetting the ink toward the recording paper P from the nozzles by controlling the ink-jet head 2 by means of the controller 6, and thus desired images, letters and the like are recorded on the recording paper P.

A cap 9 is arranged movably in the vertical direction at the retraction position positioned on one side (left side as shown in FIG. 1) in the widthwise direction of the recording paper from the recording paper transport area in which the recording paper P is transported. The cap 9 is capable of covering the lower surface (ink-jetting surface) of the ink-jet head 2 moved to the retraction position. In this arrangement, when the nozzle clog-up is caused by the contamination with, for example, the bubble or the dust in the ink flow passage in the ink-jet head 2 including the nozzles, the purge operation is executed to forcibly discharge the ink from the nozzles in the state in which the ink-jetting surface of the ink-jet head 2 is covered with the cap 9. More specifically, the ink is pressurized by the pump 5 to arrive at the pressure higher than the pressure adopted when the ink is ordinarily supplied, and the ink is supplied to the ink-jet head 2. Accordingly, the ink is jetted from the nozzles at the pressure higher than the pressure adopted during the recording so that the bubble, the dust or the like, with which the ink-jet head 2 is contaminated, is discharged together with the ink. A discharge tube 10 is connected to the cap 9. The ink, which is jetted into the cap 9 in accordance with the purge operation, is discharged to the outside of the cap 9 via the discharge tube 10.

Figure 2:
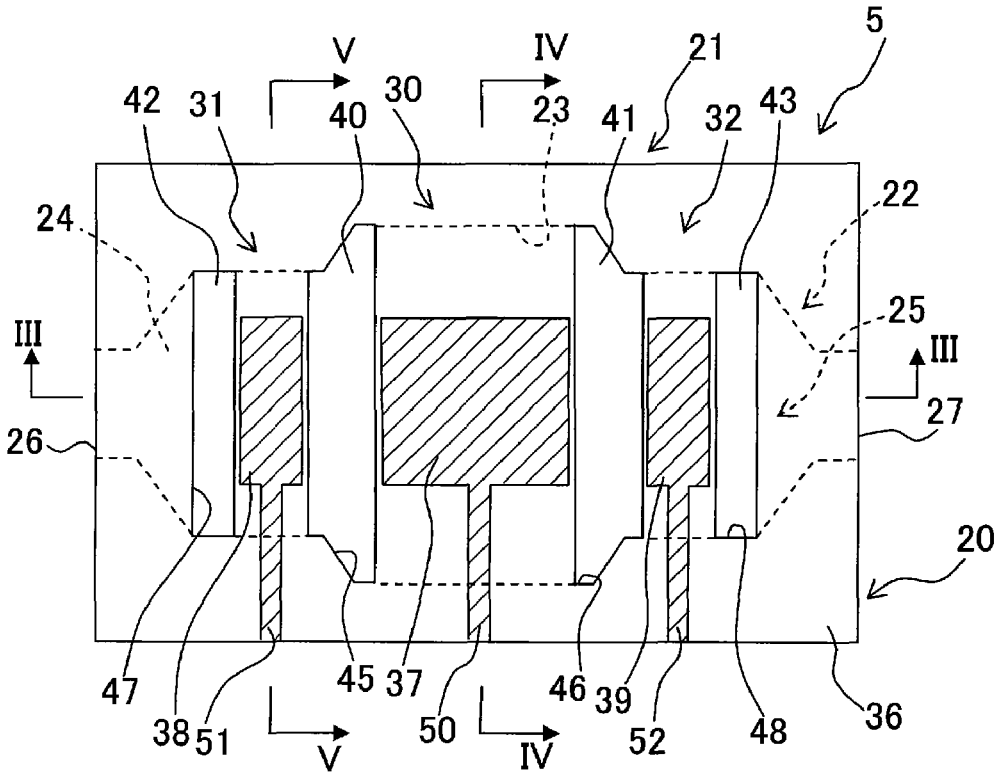
FIG. 2 shows a plan view illustrating a pump.
Figure 3:
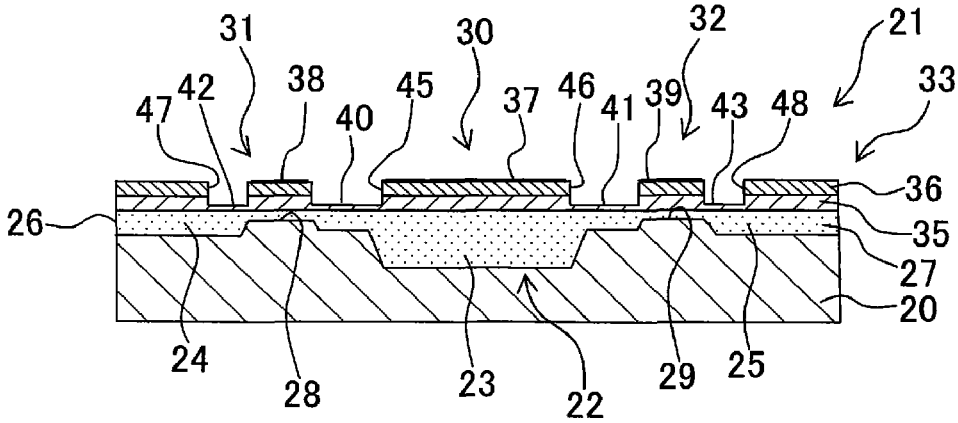
FIG. 3 shows a sectional view taken along a line III-III shown in FIG. 2.
Figure 4:
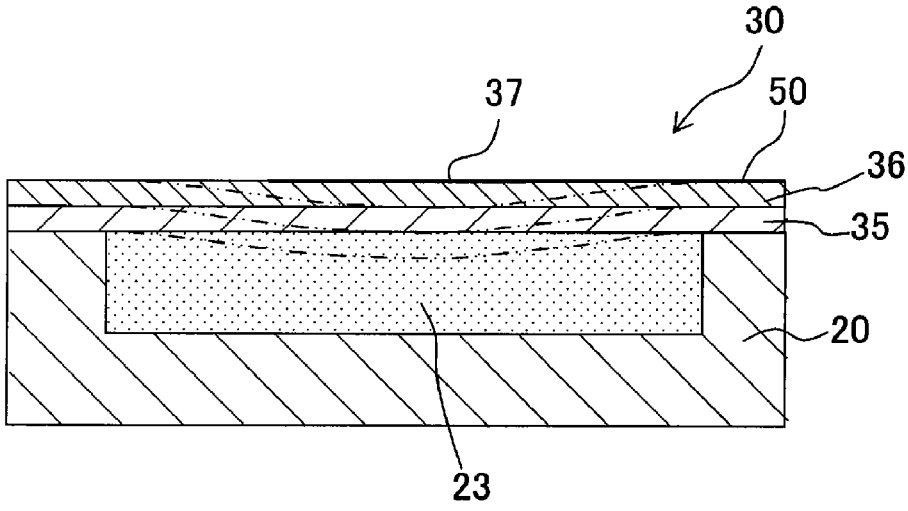
FIG. 4 shows a sectional view taken along a line IV-IV shown in FIG. 2.
Figure 5:
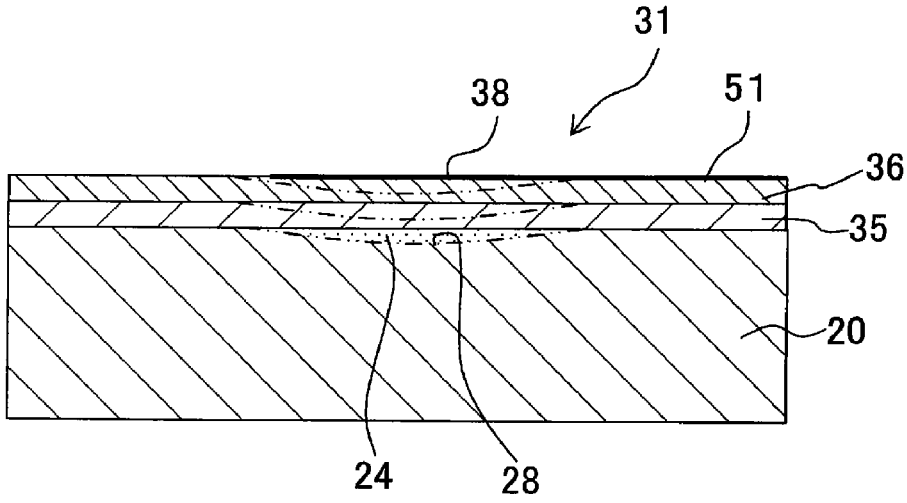
FIG. 5 shows a sectional view taken along a line V-V shown in FIG. 2.

Next, an explanation will be made with reference to FIGS. 2 to 5 about the pump 5 (liquid transport apparatus) for transporting the ink in the ink tank 4 to the ink subtank 7. FIG. 2 shows a plan view illustrating the pump 5. FIG. 3 shows a sectional view taken along a line III-III shown in FIG. 2. FIG. 4 shows a sectional view taken along a line IV-IV shown in FIG. 2. FIG. 5 shows a sectional view taken along a line V-V shown in FIG. 2. The explanation will be made, while the direction, which is directed toward the front in the plane of the paper of FIG. 2, is defined as the upper direction, and the horizontal direction in FIG. 2 is defined as the left-right direction.

As shown in FIGS. 2 to 5, the pump 5 is provided with a base member 20 which has an ink flow passage 22 formed along its upper surface, and a piezoelectric actuator 21 which is arranged on the upper surface of the base member 20.

Figure 6:
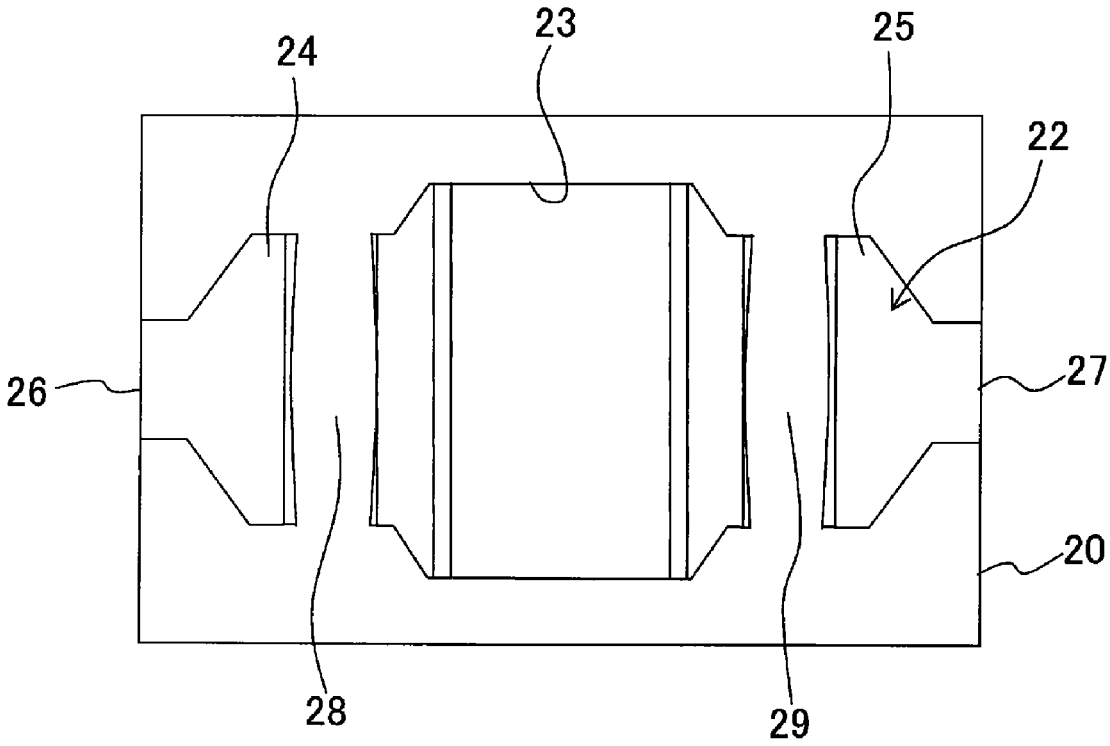
FIG. 6 shows a plan view illustrating a base member.

At first, the base member 20 will be explained. FIG. 6 shows a plan view illustrating the base member 20. As shown in FIGS. 2 and 6, the base member 20 is a plate-shaped member having a rectangular planner shape. Various materials including, for example, metal materials, synthetic resin materials, and silicon can be used for the base member 20. However, when the base member 20 is formed of a metal material such as stainless steel, the ink flow passage 22 can be formed with ease by the etching.

The ink flow passage 22, which is formed on the upper surface of the base member 20, is composed of a pressure chamber 23, and an ink supply flow passage 24 and an ink discharge flow passage 25 (liquid flow passages) which are communicated with the pressure chamber 23. The pressure chamber 23 is formed to have a recessed form at a central portion of the upper surface of the base member 20. The ink supply flow passage 24, which has a recessed form, is formed in an area disposed on the upper surface of the base member 20 at the left side of the pressure chamber 23. The ink supply flow passage 24 extends from an ink supply port 26 formed at the left end of the base member 20 to the left end of the pressure chamber 23. On the other hand, the ink discharge flow passage 25, which has a recessed form, is formed in an area disposed on the upper surface of the base member 20 at the right side of the pressure chamber 23. The ink discharge flow passage 25 extends from the right end of the pressure chamber to an ink discharge port 27 formed at the right end of the base member 20. In other words, the ink supply flow passage 24, the pressure chamber 23, and the ink discharge flow passage 25 are arranged to extend on a straight line along the upper surface of the base member 20.

The ink supply port 26 is connected via the tube 8 to the ink tank 4 shown in FIG. 1. On the other hand, the ink discharge port 27 is connected via the tube 8 to the ink subtank 7 shown in FIG. 1. Therefore, the ink, which inflows from the ink supply port 26 disposed at the left end of the base member 20, passes through the ink supply flow passage 24, and the ink is supplied to the pressure chamber 23. Further, the pressure is applied to the ink which inflowed into the pressure chamber 23 by the piezoelectric actuator 21 which will be described later on. After that, the ink passes through the ink discharge flow passage 25, the ink is discharged from the ink discharge port 27 disposed at the right end, and the ink is transported to the ink subtank 7.

As shown in FIG. 2, the ink supply flow passage 24 and the ink discharge flow passage 25 have flow passage widths (lengths in relation to the horizontal direction (upward-downward direction as shown in FIG. 2) perpendicular to the left-right direction as the ink transport direction) which are narrower than that of the pressure chamber 23. Further, the ink supply flow passage 24 and the ink discharge flow passage 25 are formed to have such shapes that the flow passage widths are narrowed at the connecting portions with respect to the ink supply port 26 and the ink discharge port 27. The flow passage shapes of the ink supply flow passage 24 and the ink discharge flow passage 25 are bilaterally symmetrical in relation to the pressure chamber 23. As a result, the ink flow passage 22 has the largest flow passage width at the pressure chamber 23 disposed at the central portion to provide such a flow passage shape that the flow passage width is narrowed at portions nearer to the ink supply port 26 disposed at the left end and the ink discharge port 27 disposed at the right end as starting from the pressure chamber 23.

In order that a large amount of the ink can be transported at once when the pressure is applied to the ink in the pressure chamber 23 by the piezoelectric actuator 21 as described later on, it is necessary that the flow passage cross-sectional area of the pressure chamber 23 (cross-sectional area in the vertical plane perpendicular to the left-right direction as the ink transport direction) should be increased to secure the volume of the pressure chamber 23 to some extent. On the other hand, as for the ink supply flow passage 24 and the ink discharge flow passage 25, it is preferable that the flow passage cross-sectional area is small to such an extent that the flow passage resistance is not excessively increased so that the flow passage can be opened and closed by the piezoelectric actuator 21 easily and quickly.

Therefore, the flow passage cross-sectional areas of the ink supply flow passage 24 and the ink discharge flow passage 25 are smaller than the flow passage cross-sectional area of the pressure chamber 23. Specifically, as shown in FIGS. 2, 4, and 5, both of the flow passage width and the flow passage depth of each of the ink supply flow passage 24 and the ink discharge flow passage 25 are smaller than the flow passage width and the flow passage depth of the pressure chamber 23 respectively.

Further, a valve seat 28, which closes the ink supply flow passage 24 in cooperation with an opening/closing portion 31 of the piezoelectric actuator 21 as described later on, is provided at an intermediate portion in the left-right direction of the ink supply flow passage 24. As shown in FIG. 5, the upper surface of the valve seat 28 is formed to provide a smooth recess-shaped curved surface which is the deepest at the central portion in the widthwise direction thereof. Similarly, a valve seat 29, which has the same shape as that of the valve seat 28 of the ink supply flow passage 24, is also provided at an intermediate portion in the left-right direction of the ink discharge flow passage 25.

Next, the piezoelectric actuator 21 will be explained. As shown in FIGS. 2 to 5, the piezoelectric actuator 21 has a pressure-applying portion 30 which applies the pressure to the ink contained in the pressure chamber 23 in order to transport the ink, and opening/closing portions 31, 32 which open and close the ink supply flow passage 24 and the ink discharge flow passage 25 respectively.

The pressure-applying portion 30 and the opening/closing portion 31 of the piezoelectric actuator 21 are composed of a stack 33 provided by stacking a plurality of layers including a piezoelectric material layer 36. More specifically, the stack 33 includes a vibration plate 35 which is arranged on the upper surface of the base member 20, the piezoelectric material layer 36 which is formed on the upper surface of the vibration plate 35 (surface disposed on the side not facing the base member 20), a driving electrode 37 (first electrode) which is formed in an area opposed to the pressure chamber 23, of the upper surface of the piezoelectric material layer 36, and two flow passage-opening/closing electrodes 38, 39 (second electrodes) which are formed in areas opposed to the ink supply flow passage 24 and the ink discharge flow passage 25 respectively.

The vibration plate 35 is a metal plate having the same rectangular planner shape as that of the base member 30. The vibration plate 35 is formed by, for example, an iron-based alloy such as stainless steel, a copper-based alloy, a nickel-based alloy, or a titanium-based alloy. The vibration plate 35 is joined to the upper surface of the base member 20 in a state in which the pressure chamber 23, the ink supply flow passage 24, and the ink discharge flow passage 25 are covered therewith from the upper position. The upper surface of the vibration plate 35, which is conductive, is opposed to the driving electrode 37 and the two flow passage-opening/closing electrodes 38, 39 with the piezoelectric material layer 36 intervening therebetween. The upper surface of the vibration plate 35 also serves as a common electrode (third electrode) which generates the electric field in the thickness direction in the piezoelectric material layer 36 with respect to the electrodes 37 to 39. According to this arrangement, it is unnecessary to form any common electrode on the lower side of the piezoelectric material layer 36 distinctly from the vibration plate 35. Therefore, the structure of the piezoelectric actuator 21 is simplified corresponding thereto.

Figure 7:
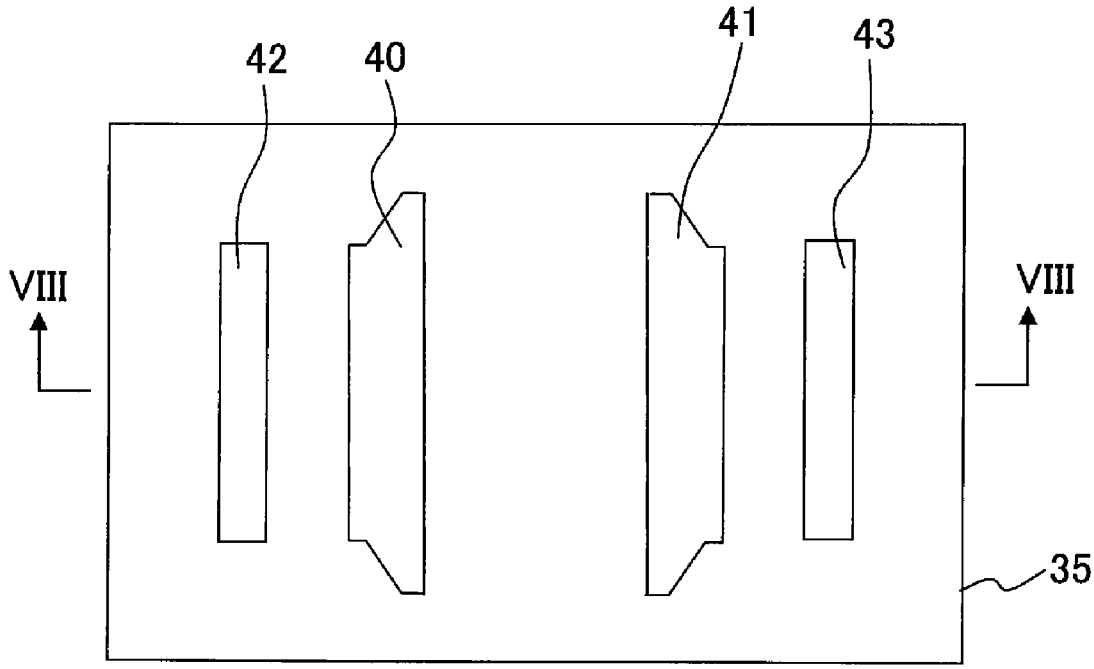
FIG. 7 shows a plan view illustrating a vibration plate.
Figure 8:
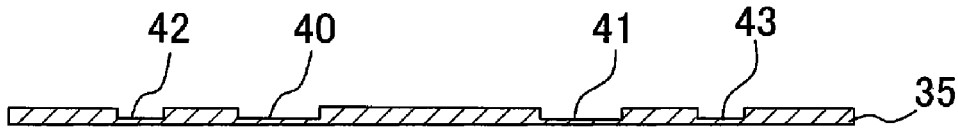
FIG. 8 shows a sectional view taken along a line VIII-VIII shown in FIG. 7.

FIG. 7 shows a plan view illustrating the vibration plate 35. FIG. 8 shows a sectional view taken along a line VIII-VIII illustrating the vibration plate 35. As shown in FIGS. 2, 3, 7, and 8, recesses 40, 41 are formed in areas of the upper surface of the vibration plate 35 (surface disposed on the side not facing the base member 20) facing the boundary between the pressure chamber 23 and the ink supply flow passage 24 and the boundary between the pressure chamber 23 and the ink discharge flow passage 25 respectively. Further, recesses 42, 43 are also formed in areas of the upper surface of the vibration plate 35 facing the upstream side (left side) from the valve seat 28 of the ink supply flow passage 24 and the downstream side (right side) from the valve seat 29 of the ink discharge flow passage 25 respectively. The four recesses 40 to 43 extend over the entire regions in the widthwise direction of the ink flow passage 22 (pressure chamber 23, ink supply flow passage 24, and ink discharge flow passage 25).

In other words, the thickness of the vibration plate 35 is locally thinned and the rigidity is lowered at the portions at which the four recesses 40 to 43 are formed. The portion of the vibration plate 35 facing the pressure chamber 23, the portion facing the valve seat 28 of the ink supply flow passage 24, and the portion facing the valve seat 29 of the ink discharge flow passage 25 are comparted by the recesses 40 to 43 as the rigidity-lowered portions.

The piezoelectric material layer 36, which is composed of the piezoelectric material provided as the solid solution of lead titanate and lead zirconate and containing the main component of lead zirconium titanate (PZT), is formed on the upper surface of the vibration plate 35. Four through-holes 45 to 48, which have the same planner shapes as those of the four recesses 40 to 43, are formed through the piezoelectric material layer 36 so that the four through-holes 45 to 48 face the recesses 40 to 43 respectively. In other words, the piezoelectric material layer 36 is formed on the entire region of the upper surface of the vibration plate 35 except for the areas in which the four recesses 40 to 43 are formed.

As shown in FIG. 2, the driving electrode 37 has a rectangular planar shape, which is arranged in an area of the upper surface of the piezoelectric material layer 36 facing the central portion of the pressure chamber 23 in relation to the flow passage widthwise direction. On the other hand, the two flow passage-opening/closing electrodes 38, 39 have slender rectangular planner shapes having lengths in the left-right direction shorter than that of the driving electrode 37, which are arranged in areas facing the central portions in the flow passage widthwise direction of the two valve seats 28, 29 respectively. Each of the three electrodes 37, 38, 39 is composed of a conductive material such as gold, copper, silver, palladium, platinum, and titanium.

Further, three wirings 50, 51, 52, which are independent from each other and which are led from the driving electrode 37 and the two flow passage-opening/closing electrodes 38, 39 to areas not facing the ink flow passage 22 (pressure chamber 23, ink supply flow passage 24, and ink discharge flow passage 25) respectively, are formed on the upper surface of the piezoelectric material layer 36. The driving electrode 37 and the two flow passage-opening/closing electrodes 38, 39 are connected via the three wirings 50 to 52 to a driver IC 60 (driver, see FIG. 9) respectively. Although not especially shown in the drawing, the vibration plate 35, which also serves as the common electrode, is also connected to the driver IC 60. The driver IC 60 is constructed as follows. That is, the vibration plate 35 is always maintained at the ground electric potential (first electric potential). Further, the ground electric potential (first electrode) and the predetermined driving electric potential (second electric potential) different from the ground electric potential are selectively applied to the driving electrode 37 and the two flow passage-opening/closing electrodes 38, 39 respectively based on the control signal fed from the controller 6 of the ink-jet printer 100. The driving electrode 37 and the flow passage-opening/closing electrodes 38, 39 are arranged on the same plane (upper surface of the piezoelectric material layer 36). Therefore, the electrode (third electrode, i.e., the upper surface of the vibration plate 30 in this embodiment), which corresponds to the electrodes 37, 38, 39, can be commonly used for the pressure-applying portion 30 and the opening/closing portions 31, 32.

When the driving electric potential is applied from the driver IC 60 to the electrode (driving electrode 37 or flow passage-opening/closing electrode 38, 39) arranged on the upper surface of the piezoelectric material layer 36, a state is provided such that the electric potential mutually differs between the electrode to which the driving electric potential is applied and the vibration plate 35 which serves as the common electrode disposed on the lower side of the piezoelectric material layer 36 retained at the ground electric potential. Therefore, the electric field is generated in the thickness direction in the piezoelectric material layer 36 interposed between the electrode disposed on the upper side and the vibration plate 35 disposed on the lower side. In this situation, when the direction of polarization of the piezoelectric material layer 36 is the same as the direction of the electric field, then the piezoelectric material layer 36 is elongated in the thickness direction as the direction of polarization, and the piezoelectric material layer 36 is shrunk in the in-plane direction perpendicular to the thickness direction (piezoelectric transverse effect). In this arrangement, the vibration plate 35 is joined to the base member 20 in the area not facing the ink flow passage 22, and the deformation thereof is restricted. Therefore, when the piezoelectric material layer 36 is shrunk in the in-plane direction, then the portion of the vibration plate 35, which faces the ink flow passage 22, is warped, and the portion is deformed to project toward the lower side (toward side of the base member 20).

In other words, the piezoelectric material layer 36 is not deformed in the area facing the pressure chamber 23 in the state in which the ground electric potential is applied to the driving electrode 37. Therefore, the vibration plate 35 is parallel to the upper surface of the base member 20 as shown by solid lines in FIG. 4. Starting from this state, when the driving electric potential is applied to the driving electrode 37, then the vibration plate 35 is deformed to project toward the base member 20 (toward the pressure chamber 23) as shown by two-dot chain lines in FIG. 4, and thus the volume of the pressure chamber 23 is decreased. Accordingly, the pressure is applied to the ink in the pressure chamber 23. According to the above, the portion of the stack 33 (portion including the driving electrode 37), which faces the pressure chamber 23, constitutes the pressure-applying portion 30 which applies the pressure to the ink in the pressure chamber 23 in order to transport the ink.

The piezoelectric material layer 36 is not deformed in the area facing the ink supply flow passage 24 in the state in which the ground electric potential is applied to the flow passage-opening/closing electrode 38. Therefore, the vibration plate 35 is parallel to the upper surface of the base member 20 as shown by solid lines in FIG. 5. In this situation, the gap is formed between the vibration plate 35 and the upper surface of the recessed valve seat 28 provided for the ink supply flow passage 24. The ink supply flow passage 24 is in the open state. On the other hand, when the driving electric potential is applied to the flow passage-opening/closing electrode 38, the vibration plate 35 is deformed to project toward the base member 20 (toward the ink supply flow passage 24) as shown by two-dot chain lines in FIG. 5. In this arrangement, the upper surface of the valve seat 28 provided for the ink supply flow passage 24 is previously formed to have the recessed form corresponding to the projection deformation of the vibration plate 35. Therefore, the vibration plate 35, which is deformed to project toward the base member 20, abuts against the recessed valve seat 28 corresponding to the projection in a state of being substantially adhered or making tight contact therewith. The ink supply flow passage 24 is reliably closed (closed state). For example, when the length in the flow passage widthwise direction of the flow passage-opening/closing electrode 38 is 10 to 15 mm, the amount of deformation of the vibration plate 35 in the direction directed toward the base member 20 may be 0.05 to 0.1 mm. According to the above, the portion of the stack 33 (portion including the flow passage-opening/closing electrode 38), which faces the ink supply flow passage 24, constitutes the opening/closing portion 31 which opens and closes the ink supply flow passage 24.

Similarly, the gap is present between the vibration plate 35 and the valve seat 29 in the state in which the ground electric potential is applied to the flow passage-opening/closing electrode 39. Therefore, the ink discharge flow passage 25 is in the open state. When the driving electric potential is applied to the flow passage-opening/closing electrode 39, then the vibration plate 35 is deformed to project, and the vibration plate 35 is allowed to substantially make tight contact with the recessed valve seat 29. Therefore, the ink discharge flow passage 25 is in the closed state. Therefore, the portion of the stack 33 (portion including the flow passage-opening/closing electrode 39), which faces the ink discharge flow passage 25, constitutes the opening/closing portion 32 which opens and closes the ink discharge flow passage 25.

As described above, the pressure-applying portion 30 is constructed by the portion of the stack 33 facing the pressure chamber 23, while the opening/closing portions 31, 32 are constructed by the portions of the stack 33 facing the ink supply flow passage 24 and the ink discharge flow passage 25. As a result, as shown in FIG. 3, the piezoelectric actuator 21 has the structure in which the pressure-applying portion 30 and the two opening/closing portions 31, 32 are arranged along the upper surface of the base member 20 (on one plane).

The driver IC 60 is connected to the driving electrode 37 and the two flow passage-opening/closing electrodes 38, 39 via the independent wirings 50 to 52. In this arrangement, the driving electric potential is applied at the predetermined timings to the three electrodes 37 to 39 respectively, and thus the pressure-applying portion 30 and the opening/closing portions 31, 32 are driven independently from each other. Therefore, it is possible to independently perform the application of the pressure by the pressure-applying portion 30 and the opening and closing of the flow passages 24, 25 by the opening/closing portions 31, 32.

As described above, the four recesses 40 to 43 are formed on the upper surface of the vibration plate 35 (surface on the side not facing the base member 20). The portions of the vibration plate 35, which face the pressure chamber 23, the valve seat 28 of the ink supply flow passage 24, and the valve seat 29 of the ink discharge flow passage 25 respectively, are comparted from each other by the recesses 40 to 43. Further, the piezoelectric material layer 36 is not formed on the surface of the four recesses 40 to 43. In other words, the portions, in which the thickness of the stack 33 is locally thinned and the rigidity is lowered, are provided at the both ends of the pressure-applying portion 30 and the opening/closing portions 31, 32 in relation to the ink transport direction (left-right direction) respectively.

When the rigidities of the vibration plate 35 and the piezoelectric material layer 36 for constructing the stack 33 are locally lowered between the pressure-applying portion 30 and the opening/closing portions 31, 32 disposed adjacently to one another as described above, the deformations of the piezoelectric material layer 36 and the vibration plate 35, which are brought about when the driving electric potential is applied to the electrodes, are hardly transmitted. In other words, the mutual interference of the deformations of the piezoelectric material layer 36 and the vibration plate 35 is suppressed between the pressure-applying portion 30 and the opening/closing portions 31, 32. Therefore, the independent operations of the pressure-applying portion 30 and the opening/closing portions 31, 32 are guaranteed. The fact that the rigidity-lowered portions are arranged at the both ends of the pressure-applying portion 30 and the opening/closing portions 31, 32 means, in other words, the fact that the rigidities are lowered in the driven areas disposed on the both sides of the area (driving area) in which the piezoelectric material layer 36 is spontaneously deformed while facing the electrode. When the rigidity of the driven area is low as described above, the vibration plate is deformed more largely with ease. Therefore, it is possible to increase the amount of deformation of the vibration plate by using the small driving electric potential. Therefore, it is possible to efficiently drive the pressure-applying portion 30 and the opening/closing portions 31, 32.

Figure 9:
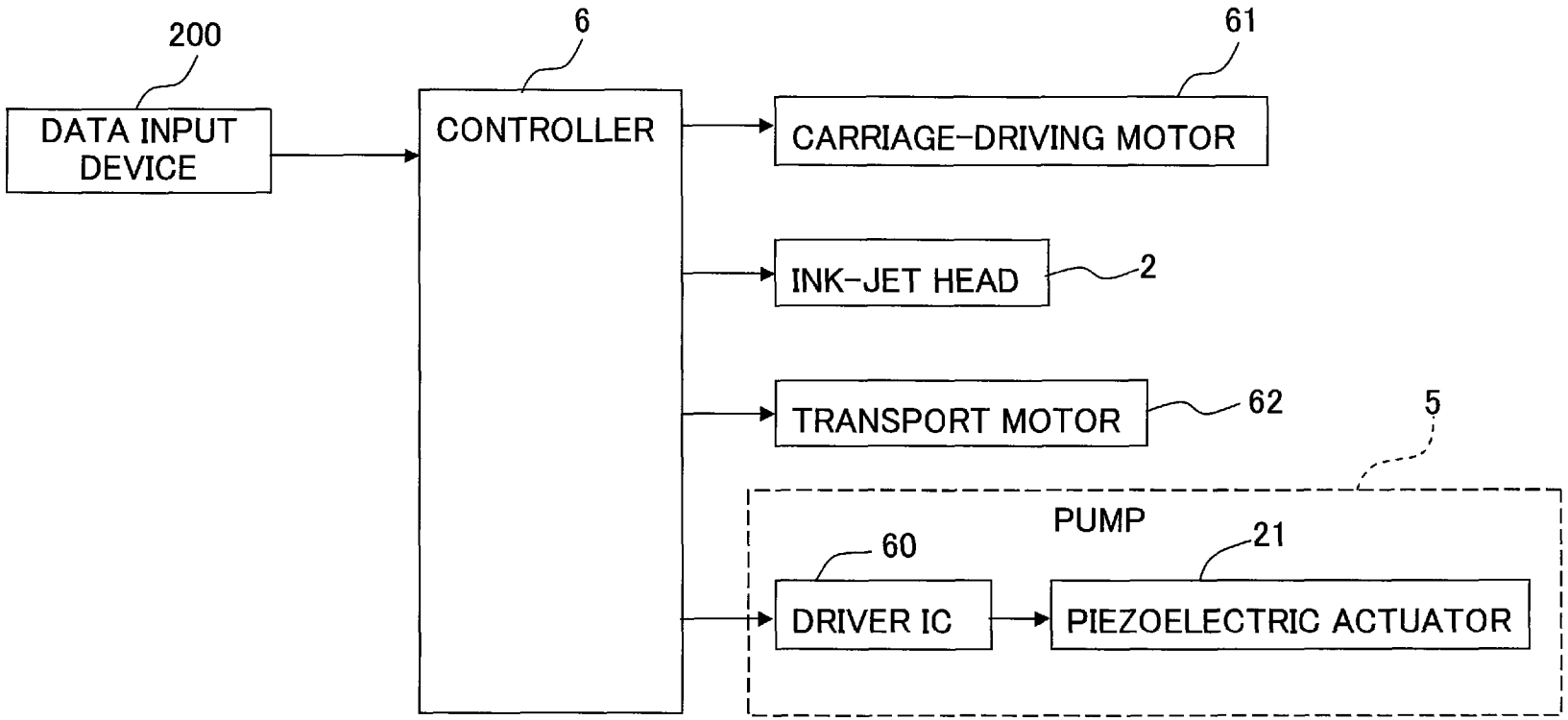
FIG. 9 shows a block diagram schematically illustrating an electric arrangement of the ink-jet printer.

Next, a brief description will be made with reference to a block diagram shown in FIG. 9 about the controller 6 which controls the operations of the respective portions of the ink-jet printer 100 (see FIG. 1) including the pump 5 described above. The controller 6 manages the control of the various operations of the printer 100 including, for example, the reciprocating operation of the carriage 1, the ink-jetting operation of the ink-jet head 2, the operation for transporting the recording paper P by the transport rollers 3, and the ink transport operation by the pump 5. The controller 6 is provided with, for example, CPU (Central Processing Unit) which is the central processing unit or the central processor, ROM (Read Only Memory) which stores, for example, the program and the data for controlling the printer 100, and RAM (Random Access Memory) which temporarily stores the data to be processed by CPU.

The controller 6 controls a carriage-driving motor 61 for reciprocatively driving the carriage 1, the ink-jet head 2, and a transport motor 62 for driving the transport rollers 3 based on the data in relation to, for example, the recording image inputted from a data input device 200 such as PC to record, for example, the desired image on the recording paper P. Further, the controller 6 controls the piezoelectric actuator 21 of the pump 5 (specifically the driver IC 60) so that the ink, which is stored in the ink tank 4, is supplied by the pump 5 to the ink-jet head 2.

Next, an explanation will be made with reference to FIG. 10 about an example of the ink transport operation by the pump 5. In FIG. 10, the symbol "+" indicates the state in which the electrode potential is the driving electric potential, and the symbol "GND" indicates the state in which the electrode potential is the ground electric potential.

Figure 10A:
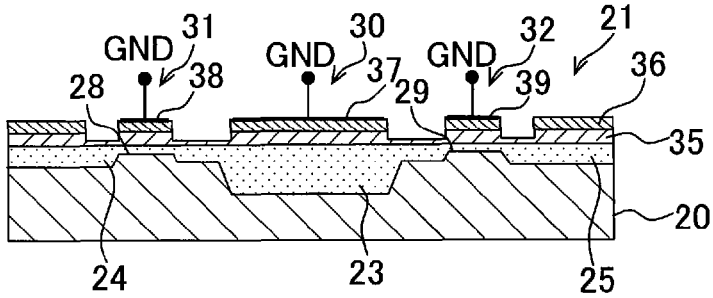

At first, as shown in FIG. 10A, when the operation of the pump 5 is stopped, all of the electric potentials of the three electrodes 37 to 39, i.e., the driving electrode 37 of the pressure-applying portion 30 and the flow passage-opening/closing electrodes 38, 39 of the opening/closing portions 31, 32 are retained at the ground electric potential by the driver IC 60. No electric potential difference is generated between the three electrodes 37 to 39 and the vibration plate 35 as the common electrode. Therefore, the shrinkage, which is to be caused by the piezoelectric transverse effect, is not generated in the piezoelectric material layer 36. The vibration plate 35 is parallel to the upper surface of the base member 20. In this situation, the gaps are formed between the vibration plate 35 and the valve seats 28, 29 in the ink supply flow passage 24 and the ink discharge flow passage 25. Both of the ink supply flow passage 24 and the ink discharge flow passage 25 are in the open state.

Figure 10B:
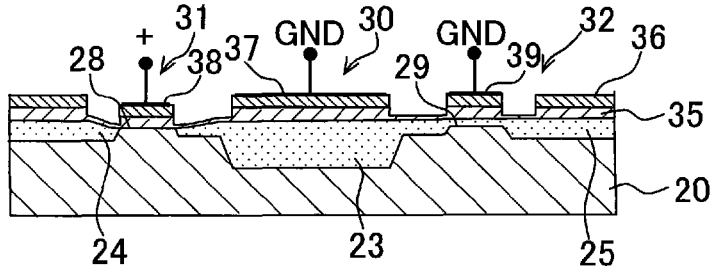

Starting from this state, when the electric potential of the flow passage-opening/closing electrode 38 facing the ink supply flow passage 24 is switched to the driving electric potential by the driver IC 60 as shown in FIG. 10B, the vibration plate 35 is deformed to project toward the base member 20 at the opening/closing portion 31. In this situation, the vibration plate 35 is allowed to substantially make tight contact with the upper surface of the valve seat 28 formed to have the recessed form, and the gap between the vibration plate 35 and the valve seat 28 is plugged. Therefore, the ink supply flow passage 24 is closed.

Figure 10C:
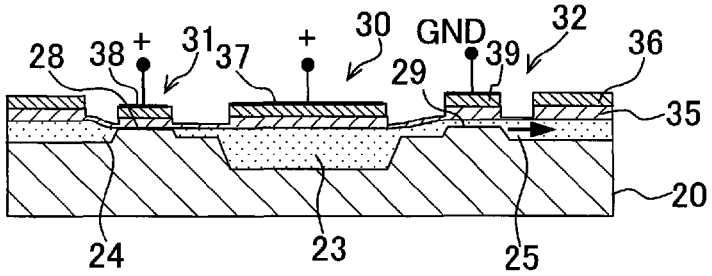

Further, as shown in FIG. 10C, when the electric potential of the driving electrode 37 facing the pressure chamber 23 is switched to the driving electric potential, the vibration plate 35 is deformed to project toward the base member 20 at the pressure-applying portion 30. Accordingly, the volume of the pressure chamber 23 is decreased. Therefore, the pressure is applied to the ink in the pressure chamber 23, and the ink is discharged from the pressure chamber 23 to the ink discharge flow passage 25. In this situation, the ink supply flow passage 24, which is disposed on the upstream side of the pressure chamber 23, is closed by the opening/closing portion 31. Therefore, the pressure wave, which is generated in the pressure chamber 23, is not allowed to escape to the ink supply flow passage 24. Therefore, it is possible to transport the ink efficiently.

Figure 10D:
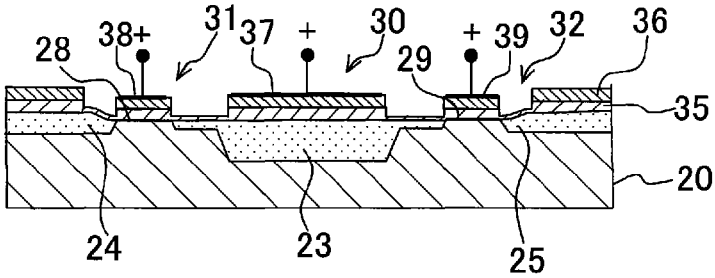

Subsequently, as shown in FIG. 10D, the electric potential of the flow passage-opening/closing electrode 39 of the opening/closing portion 32 facing the ink discharge flow passage 25 is switched to the driving electric potential in conformity with the timing at which the ink discharge from the pressure chamber 23 is completed. Accordingly, the vibration plate 35 is deformed to project toward the base member 20 at the opening/closing portion 32, and the vibration plate 35 is allowed to substantially make tight contact with the upper surface of the valve seat 29. Therefore, the ink discharge flow passage 25 is closed.

Figure 10E:
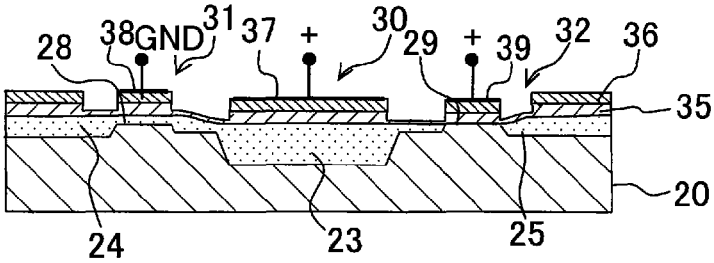
Figure 10F:
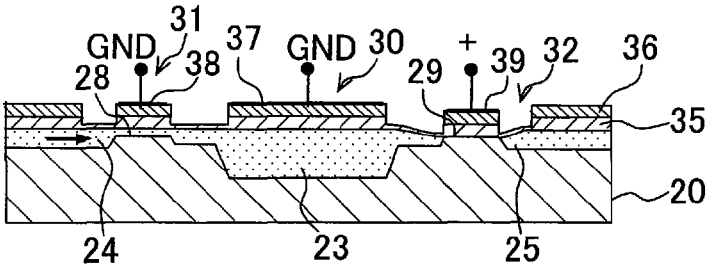

Subsequently, as shown in FIG. 10E, when the electric potential of the electrode 38 facing the ink supply flow passage 24 is switched to the ground electric potential by the driver IC 60, the ink supply flow passage 24 is opened again. Further, as shown in FIG. 10F, when the electric potential of the driving electrode 37 facing the pressure chamber 23 is switched to the ground electric potential, then the vibration plate 35 is returned to have the flat shape at the pressure-applying portion 30, and the volume of the pressure chamber 23 is increased. In this situation, the ink discharge flow passage 25 is closed by the opening/closing portion 32. Accordingly, the pressure of the ink in the pressure chamber 23 is suddenly lowered in accordance with the increase in the volume of the pressure chamber 23, and the ink is allowed to inflow from the ink supply flow passage 24 into the pressure chamber 23. After that, the ink supply flow passage 24 is closed again by the opening/closing portion 31. Further, the ink discharge flow passage 25 is opened by the opening/closing portion 32 (FIG. 10B), and then the pressure is applied to the ink in the pressure chamber 23 by the pressure-applying portion 30 (FIG. 10C).

As described above, a series of operations are repeated such that the pressure is applied in the pressure chamber 23 to the ink supplied from the ink supply flow passage 24 into the pressure chamber 23, and the ink is discharged from the ink discharge flow passage 25. Thus, the ink contained in the ink tank 4 is transported to the ink subtank 7.

Figure 11A:
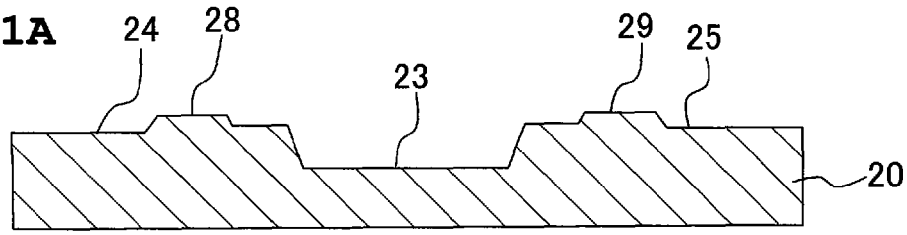

Next, an explanation will be made with reference to FIG. 11 about a method for producing the pump 5 of this embodiment. At first, as shown in FIG. 11A, the pressure chamber 23 is formed on the upper surface of the base member 20, and the ink supply flow passage 24 and the ink discharge flow passage 25, which are communicated with the pressure chamber 23 and which have the flow passage cross-sectional areas smaller than that of the pressure chamber 23, are formed on the upper surface of the base member 20 (flow passage-forming step). In this procedure, when the base member 20 is a metal plate, the ink flow passage 22, which has a relatively complicated shape including the valve seats 28, 29, can be formed with ease by means of the etching.

Figure 11B:
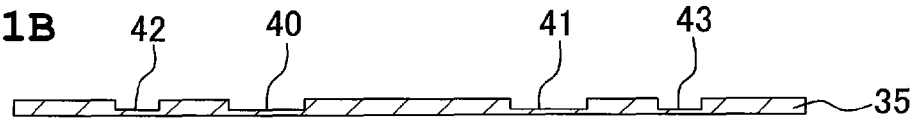

The piezoelectric actuator 21, which is to be arranged on the upper surface of the base member 20, is produced concurrently with the flow passage-forming step (actuator-producing step). At first, as shown in FIG. 11B, the four recesses 40 to 43, which are provided to locally lower the rigidity of the vibration plate 35, are formed by means of the etching on the upper surface of the vibration plate 35 formed by the metal material.

Figure 11C:
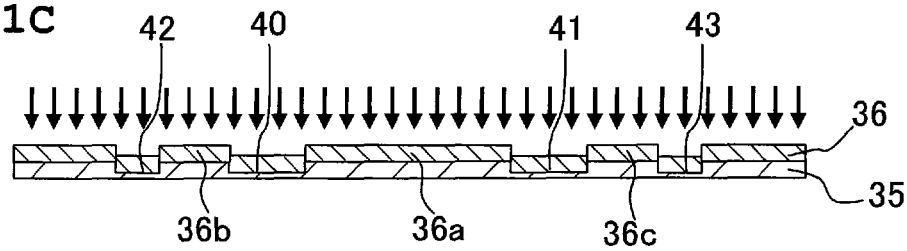

Subsequently, as shown in FIG. 11C, the piezoelectric material layer 36 is formed on the entire region of the upper surface of the vibration plate 35 on which the four recesses 40 to 43 have been formed (piezoelectric material layer-forming step). In this procedure, in the piezoelectric material layer-forming step, the piezoelectric material layer 36*a* of the pressure-applying portion 30 to face the pressure chamber 23 and the piezoelectric material layers 36*b*, 36*c* of the opening/closing portions 31, 32 to face the ink supply flow passage 24 and the ink discharge flow passage 25 respectively can be formed simultaneously by depositing the particles of the piezoelectric material on the upper surface of the vibration plate 35. For example, the aerosol deposition (AD) method, in which the aerosol prepared by mixing the carrier gas and the particles composed of the piezoelectric material is allowed to collide with the film formation objective (vibration plate 35) at a high velocity to deposit the particles thereby, can be adopted as a specified method for forming the piezoelectric material layer 36. Alternatively, it is also possible to use the sputtering method and the chemical vapor deposition (CVD) method.

Figure 11D:
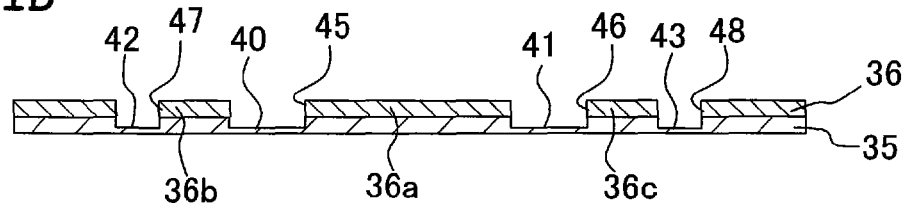

After that, as shown in FIG. 11D, the piezoelectric material, which has been deposited on the surfaces of the four recesses 40 to 43, is removed, for example, by irradiating the laser to form the four through-hole 45 to 48 corresponding to the four recesses 40 to 43 respectively.

Alternatively, in the piezoelectric material layer-forming step shown in FIG. 11C, a mask material, which covers only the four recesses 40 to 43, may be arranged on the upper surface of the vibration plate 35, and then the particles of the piezoelectric material may be deposited in the area of the upper surface of the vibration plate 35 not covered with the mask material. In the case of this procedure, the piezoelectric material is not deposited on the surfaces of the recesses 40 to 43 of the vibration plate 35. Therefore, it is unnecessary to perform the step of removing the piezoelectric material disposed on the recess surface by means of the laser or the like.

Figure 11E:
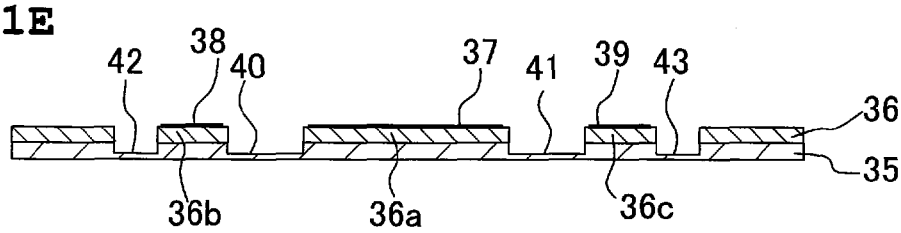

Subsequently, as shown in FIG. 11E, the electrodes 37 to 39 are formed at the portions 36*a* to 36*c* of the upper surface of the piezoelectric material layer 36 interposed between the four recesses 40 to 43 respectively (electrode-arranging step). That is, the driving electrode 37 is formed on the upper surface of the piezoelectric material layer 36*a* of the pressure-applying portion 30 to face the pressure chamber 23. Further, the flow passage-opening/closing electrodes 38, 39 are formed on the upper surfaces of the piezoelectric material layers 36*b*, 36*c* of the opening/closing portions 31, 32 to face the ink supply flow passage 24 and the ink discharge flow passage 25 respectively.

In this procedure, for example, when the screen printing method is used, the driving electrode 37 and the two flow passage-opening/closing electrodes 38, 39 can be formed at once on the upper surface of the piezoelectric material layer 36. Alternatively, the driving electrode 37 and the flow passage-opening/closing electrodes 38, 39 may be formed such that a conductive film is formed on the entire surface of the piezoelectric material layer 36, for example, by means of the vapor deposition method, and then any conductive layer, which is disposed on unnecessary areas, is removed, for example, by the laser. As described above, in this embodiment, the upper surface of the vibration plate 35 also serves as the common electrode (third electrode) facing the three electrodes 37 to 39 disposed on the upper surface of the piezoelectric material layer 36. Therefore, the step of forming the common electrode on the lower side of the piezoelectric material layer 36 is omitted. According to the steps as described above, the piezoelectric actuator 21 is produced, which has such a structure that the pressure-applying portion 30 and the opening/closing portions 31, 32 are arranged along one plane.

The recesses 40 to 43 of the vibration plate 35 may be formed on any one of the upper surface and the lower surface. However, in particular, when the recesses 40 to 43 are formed on the upper surface of the vibration plate 35, all of the plurality of steps (formation of the recesses 40 to 43 of the vibration plate 35 (FIG. 11B), formation of the piezoelectric material layer 36 (FIG. 11C), removal of the piezoelectric material from the recess surface by means of the laser or the like (FIG. 11D), and electrode formation (FIG. 11E)), which are included in the steps of producing the actuator, can be executed in the same direction (from the upper side). Therefore, it is easy to produce the piezoelectric actuator 21, and it is possible to shorten the steps.

Figure 11F:
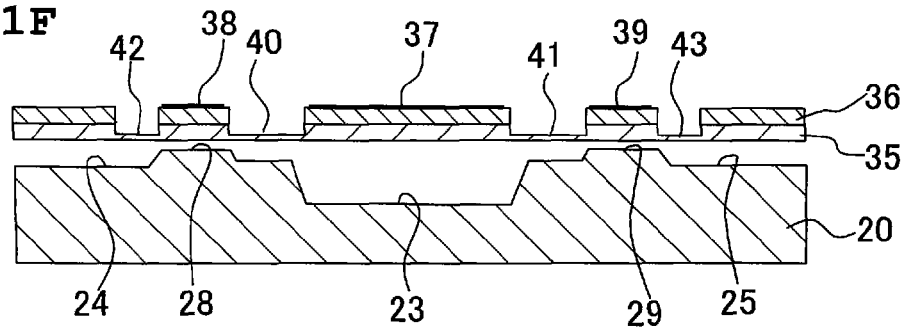

Finally, as shown in FIG. 11F, the piezoelectric actuator 21 is installed on the upper surface of the base member 20 so that the pressure-applying portion 30 faces the pressure chamber 23, and the opening/closing portions 31, 32 face the ink supply flow passage 24 and the ink discharge flow passage 25, and the lower surface of the vibration plate 35 and the upper surface of the base member 20 are joined to one another by using, for example, an adhesive. In accordance with the above, the production of the pump 5 is completed.

According to the pump 5 of this embodiment as explained above, the following effect is obtained. The pump 5 of this embodiment has the pressure-applying portion 30 which applies the pressure to the ink in the pressure chamber 23, and the opening/closing portions 31, 32 which open and close the ink supply flow passage 24 and the ink discharge flow passage 25 communicated with the pressure chamber 23 respectively. The pressure-applying portion 30 and the opening/closing portions 31, 32 are driven independently from each other. Therefore, the pressure is applied to the ink in the pressure chamber 23 at the appropriate timing by means of the pressure-applying portion 30, while opening and closing the ink supply flow passage 24 and the ink discharge flow passage 25 by means of the opening/closing portions 31, 32 respectively. Accordingly, it is possible to efficiently transport the ink. No sliding portion is present in the piezoelectric actuator 21 unlike the mechanical pump (for example, a tube pump and a syringe pump) having been hitherto widely used as the liquid transport pump. Therefore, an advantage is also obtained such that the noise, which is generated during the operation, is small.

Further, the piezoelectric actuator 21 has the stack 33 which includes, for example, the vibration plate 35, the piezoelectric material layer 36, and the electrodes 37 to 39 allowed to extend along one surface of the base member 20. The portion of the stack 33, which faces the pressure chamber 23, is the pressure-applying portion 30. The portions of the stack 33, which face the ink supply flow passage 24 and the ink discharge flow passage 25, are the opening/closing portions 31, 32 respectively. As a result, the pressure-applying portion 30 and the opening/closing portions 31, 32 are arranged on the same plane along with one surface of the base member 20. Therefore, the structure of the piezoelectric actuator 21 is simpler than any three-dimensional structure in which the pressure-applying portion and the opening/closing portion are arranged on distinct planes. It is possible to provide the small size of the pump 5 by making the piezoelectric actuator 21 to be compact.

The pressure-applying portion 30 and the opening/closing portions 31, 32, which are positioned on the same plane, can be simultaneously produced by stacking the plurality of layers including the vibration plate 35, the piezoelectric material layer 36, and the electrodes 37 to 39 on the upper surface of the base member 20. In particular, when the method, in which the particles of the piezoelectric material are deposited on the upper surface of the vibration plate 35, is adopted in the piezoelectric material layer-forming step, the piezoelectric material layers 36 of the pressure-applying portion 30 and the opening/closing portions 31, 32 can be simultaneously formed on the vibration plate 35. Therefore, it is possible to simplify the steps of producing the piezoelectric actuator 21.

Next, an explanation will be made about modified embodiments to which various modifications are applied to the embodiment described above. However, those constructed in the same manner as in the embodiment described above are designated by the same reference numerals, any explanation of which will be appropriately omitted.

Figure 12:
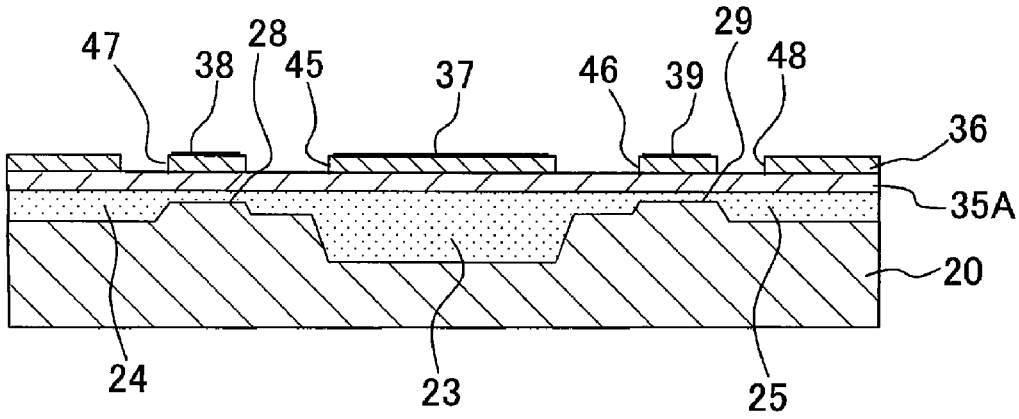
FIG. 12 shows a sectional view illustrating a pump of a first modified embodiment corresponding to FIG. 3.
Figure 13:
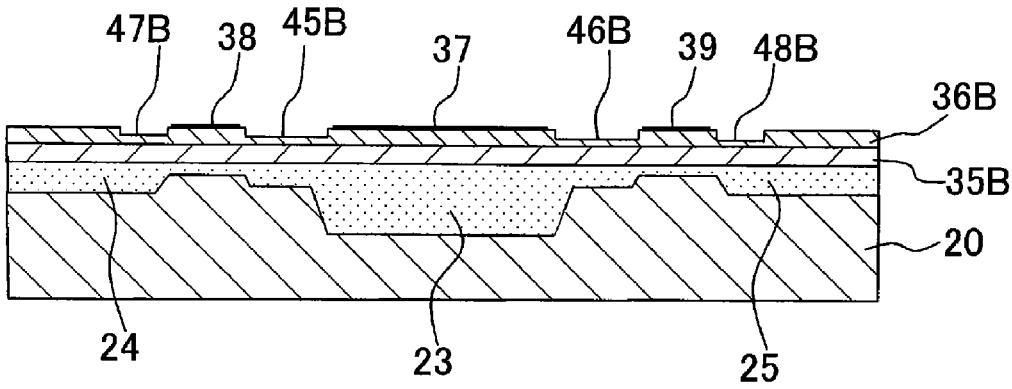
FIG. 13 shows a sectional view illustrating a pump of a second modified embodiment corresponding to FIG. 3.

In the embodiment described above, the recesses 40 to 43 are formed at the both ends of the pressure-applying portion 30 and the opening/closing portions 31, 32. On this condition, the through-holes 45 to 48, which correspond to the recesses 40 to 43, are formed through the piezoelectric material layer 36 (see FIG. 3). However, as shown in FIG. 12, it is also allowable that no recess is formed on a vibration plate 35A, and only the four through-holes 45 to 48 are formed through the piezoelectric material layer 36 (first modified embodiment). Alternatively, as shown in FIG. 13, it is also allowable that no recess is formed on a vibration plate 35B, and four recesses 45B to 48B are formed on a piezoelectric material layer 36B in place of the four through-holes 45 to 48 of the first modified embodiment (second modified embodiment). Even when the through-holes and/or the recesses are formed for only the piezoelectric material layer, the rigidity of the stack for constructing the piezoelectric actuator is lowered to some extent. Therefore, an effect is obtained such that the amount of displacement of the vibration plate is increased, and the mutual interference is avoided between the pressure-applying portion and the opening/closing portion.

Figure 14:
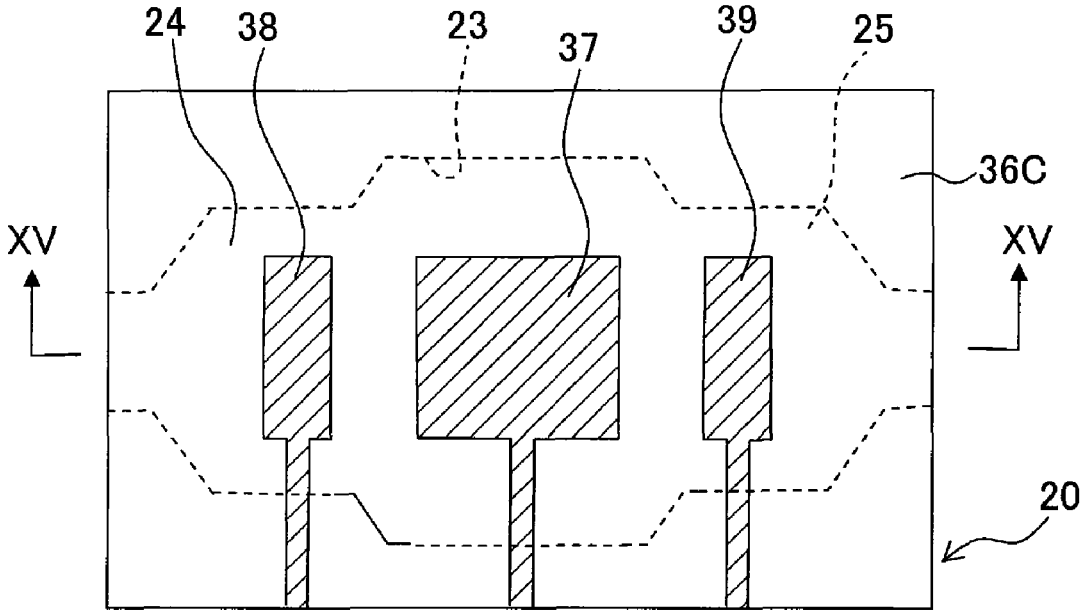
FIG. 14 shows a plan view illustrating a pump of a third modified embodiment.
Figure 15:
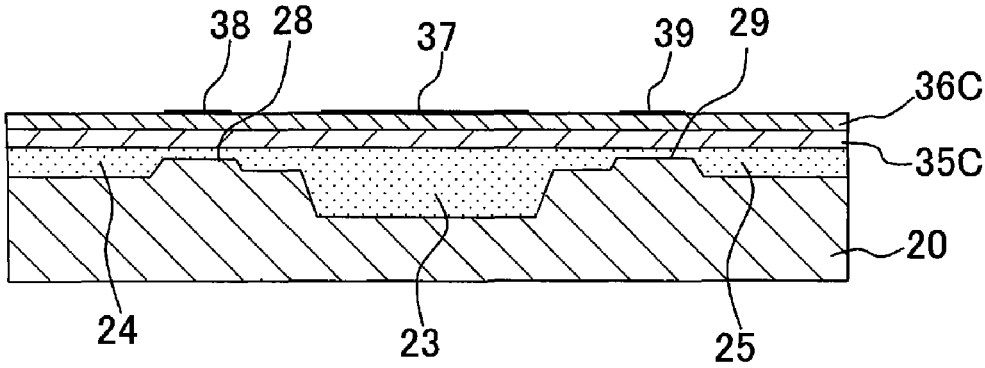
FIG. 15 shows a sectional view taken along a line XV-XV shown in FIG. 14.

When it is unnecessary to progressively suppress the mutual interference between the pressure-applying portion and the opening/closing portion, for example, when the distance between the pressure-applying portion and the opening/closing portion is sufficiently far, then it is unnecessary to provide any rigidity-lowered portion for the stack for constructing the piezoelectric actuator. In other words, as shown in FIGS. 14 and 15, it is also allowable that no recess is formed for a vibration plate 35C, neither through-hole nor recess is formed for a piezoelectric material layer 36C as well, and the piezoelectric material layer 36C is formed continuously while ranging over the pressure chamber 23, the ink supply flow passage 24, and the ink discharge flow passage 25 (third modified embodiment). In this arrangement, it is unnecessary to perform the step of forming the recess for the vibration plate and the step of forming the through-hole and/or the recess for the piezoelectric material layer. Therefore, it is possible to simplify the production steps.

Figure 16:
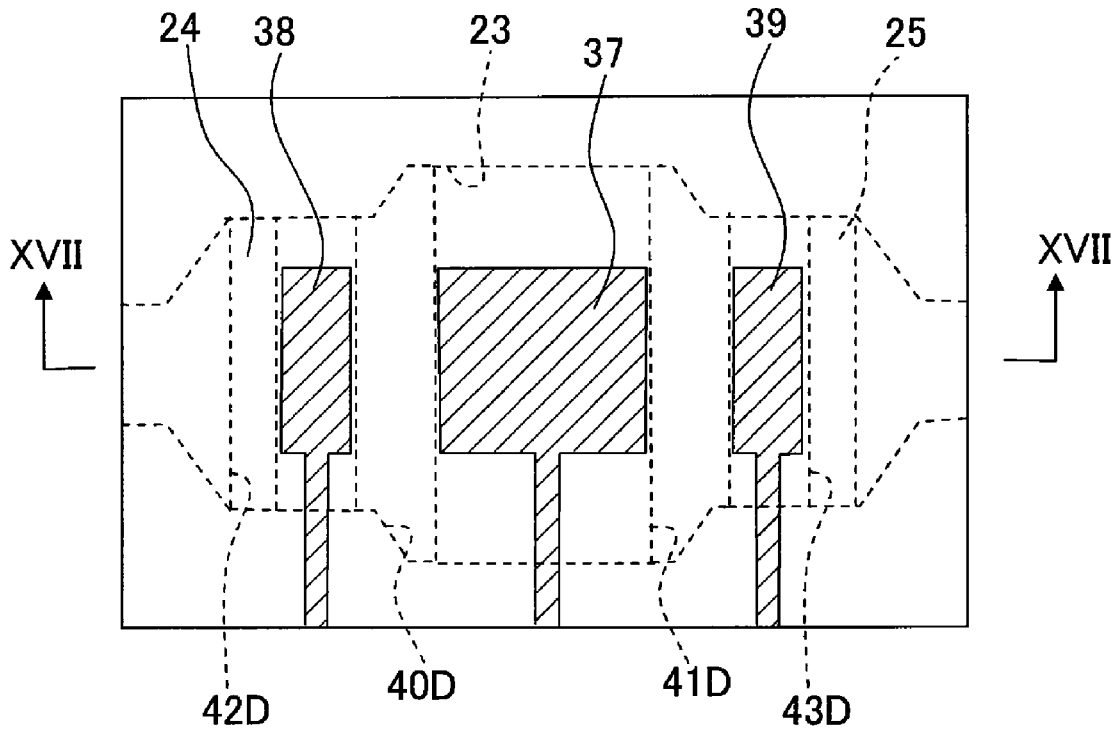
FIG. 16 shows a plan view illustrating a pump of a fourth modified embodiment.
Figure 17:
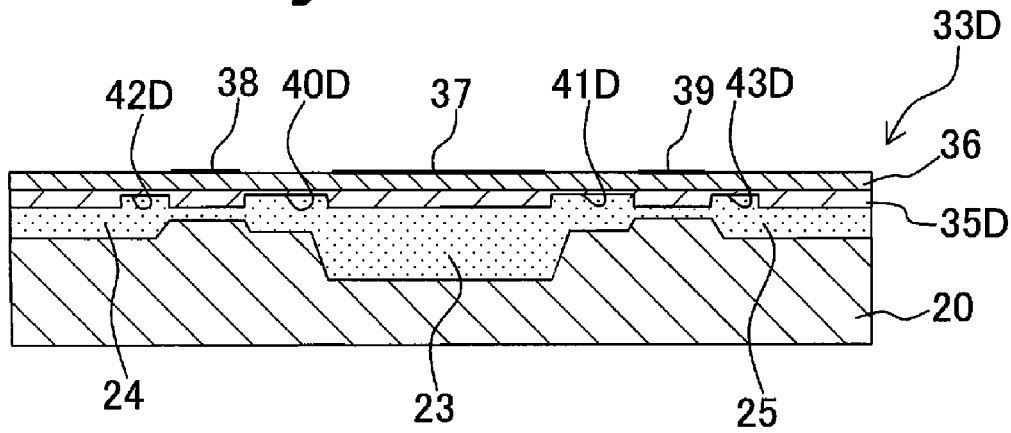
FIG. 17 shows a sectional view taken along a line XVII-XVII shown in FIG. 16.

As shown in FIGS. 16 and 17, recesses 40D to 43D, which are provided to locally lower the rigidity of a stack 33D, may be formed on the lower surface of a vibration plate 35D (fourth modified embodiment). However, in this arrangement, if any bubble is mixed into the ink, the bubble tends to stay in the recesses 40D to 43D. Therefore, it is feared that the desired pressure cannot be applied to the ink by means of the pressure-applying portion. On the other hand, when the recesses 40 to 43 are formed on the upper surface of the vibration plate 35 (surface disposed on the side not facing the base member) as in the embodiment described above, the lower surface of the vibration plate 35, which makes contact with the ink, is the flat surface. Therefore, the bubble hardly stays (see FIG. 3). From this viewpoint, it is preferable that the recesses are formed on the upper surface of the vibration plate.

Figure 18:
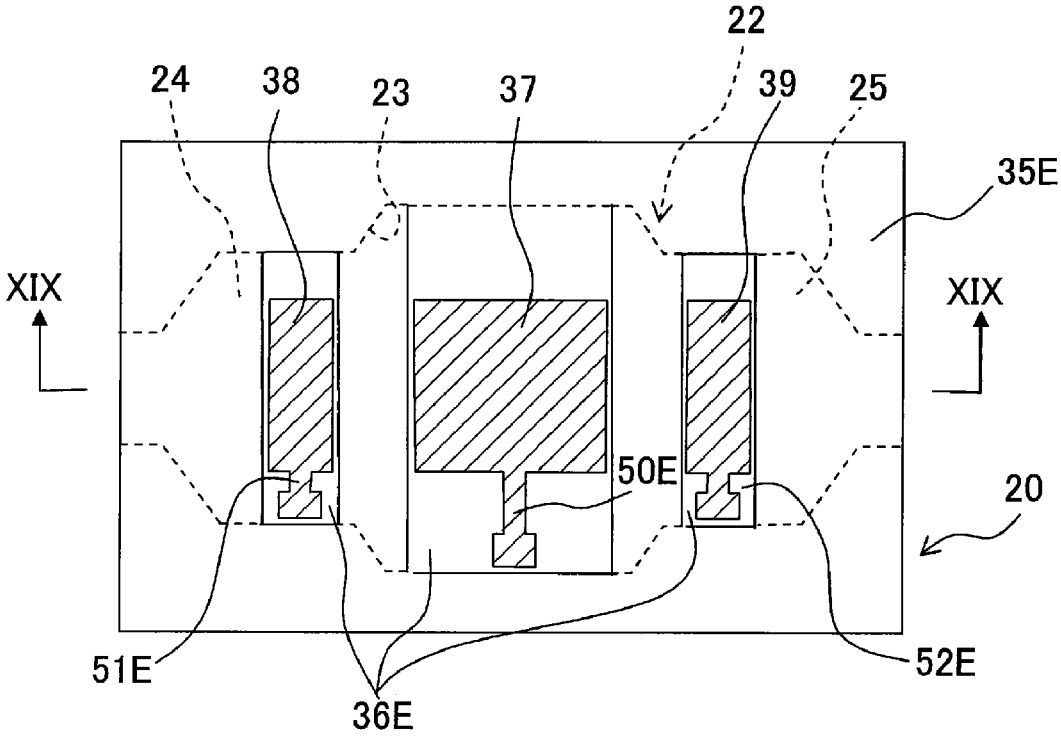
FIG. 18 shows a plan view illustrating a pump of a fifth modified embodiment.
Figure 19:
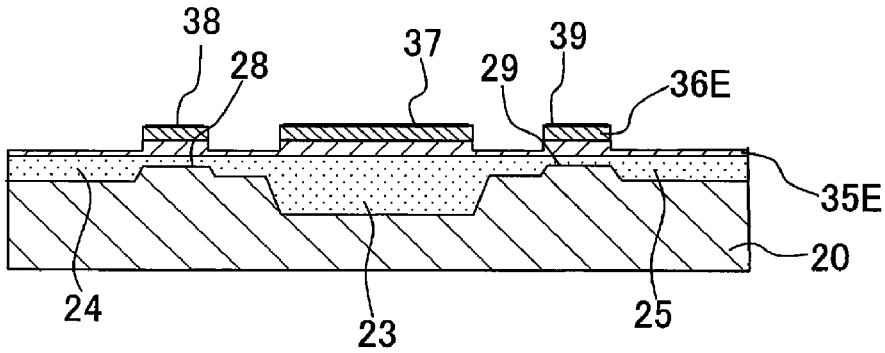
FIG. 19 shows a sectional view taken along a line XIX-XIX shown in FIG. 18.

In the embodiment described above, the piezoelectric material layer 36 is formed to the area outside the ink flow passage 22 including, for example, the pressure chamber 23. Therefore, the deformation of the piezoelectric material layer 36 is restricted, and the amount of displacement of the vibration plate 35 is decreased in the area facing the ink flow passage 22. Accordingly, as shown in FIGS. 18 and 19, it is also allowable that a piezoelectric material layer 36E is formed in only areas of the upper surface of a vibration plate 35E facing the pressure chamber 23 and the valve seats 28, 29 (fifth modified embodiment).

Also in the fifth modified embodiment, wirings 50E to 52E, which are independent from each other, are led from the three electrodes 37 to 39 formed on the upper surface of the piezoelectric material layer 36E. However, the wirings 50E to 52E cannot be led to the area outside the ink flow passage 22 (conduction is caused with the upper surface of the vibration plate 35E retained at the ground electric potential, because the piezoelectric material layer 36E is absent in the area outside the ink flow passage 22). Therefore, the fifth modified embodiment include contacts which are provided at the ends of the three wirings 50E to 52E on the side opposite to the electrodes and which make connection between the electrodes 37 to 39 and the driver IC 60, for example, via FPC (flexible printed circuit board). The contacts are positioned in areas facing the ink flow passage 22 (pressure chamber 23 and valve seats 28, 29).

Figure 20:
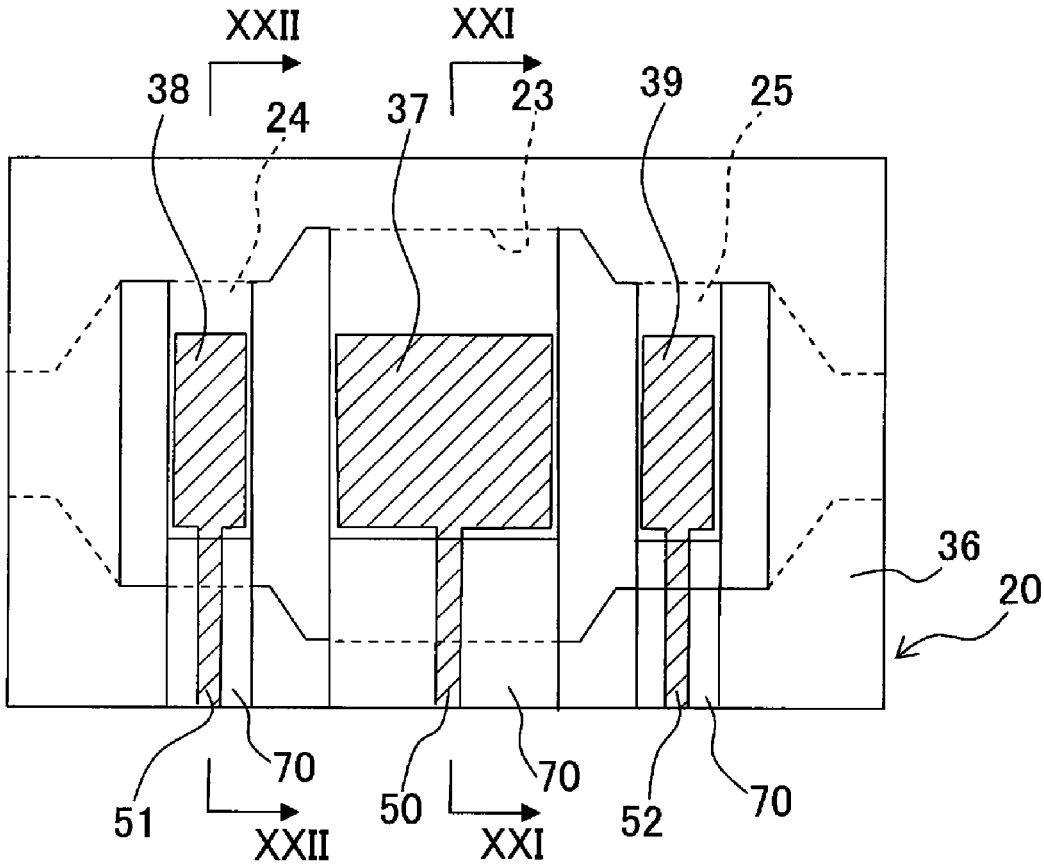
FIG. 20 shows a plan view illustrating a pump of a sixth modified embodiment.
Figure 21:
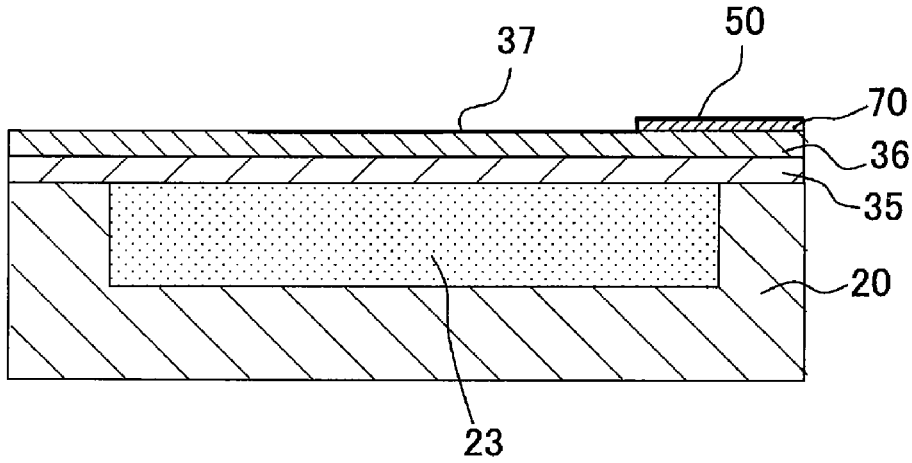
FIG. 21 shows a sectional view taken along a line XXI-XXI shown in FIG. 20.
Figure 22:
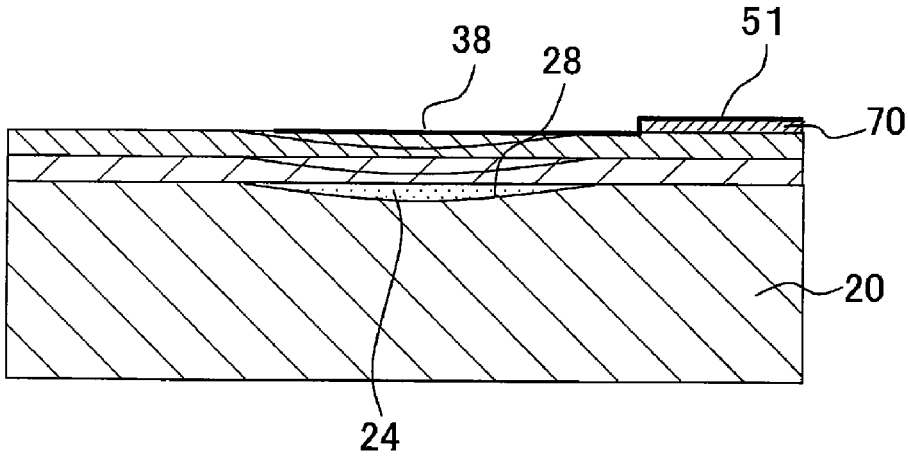
FIG. 22 shows a sectional view taken along a line XXII-XXII shown in FIG. 20.

When the wiring is led from the electrode formed on the upper surface of the piezoelectric material layer, any unnecessary electrostatic capacity (parasitic capacitance) is generated in the piezoelectric material layer between the wiring and the vibration plate when the driving electric potential is applied to the electrode. Accordingly, as shown in FIGS. 20 to 22, an insulating layer 70, which is composed of an insulative material having a dielectric constant lower than that of the piezoelectric material layer 36, may be formed between the upper surface of the piezoelectric material layer 36 and the wirings 50 to 52 (sixth modified embodiment). The insulating layer 70 can be formed of, for example, a ceramics material such as alumina and zirconia or a rein material such as polyimide.

Figure 23:
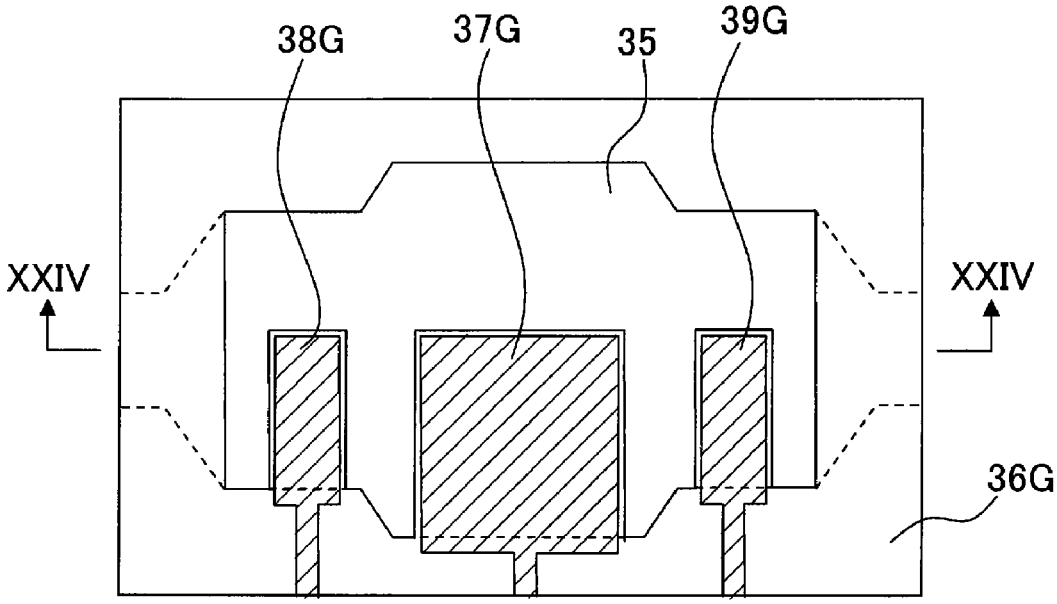
FIG. 23 shows a plan view illustrating a pump of a seventh modified embodiment.
Figure 24:
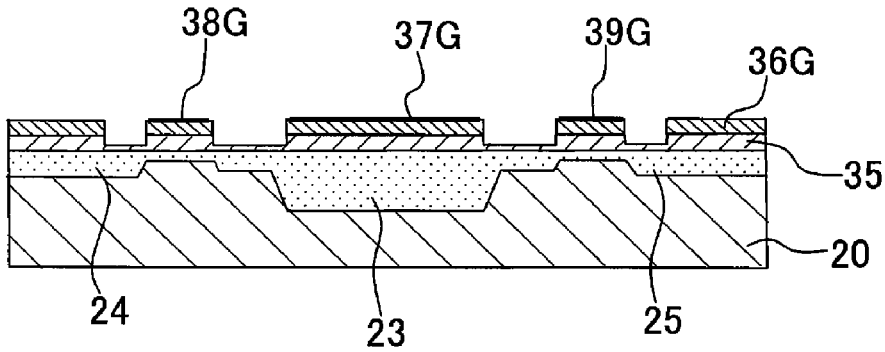
FIG. 24 shows a sectional view taken along a line XXIV-XXIV shown in FIG. 23.
Figure 25:
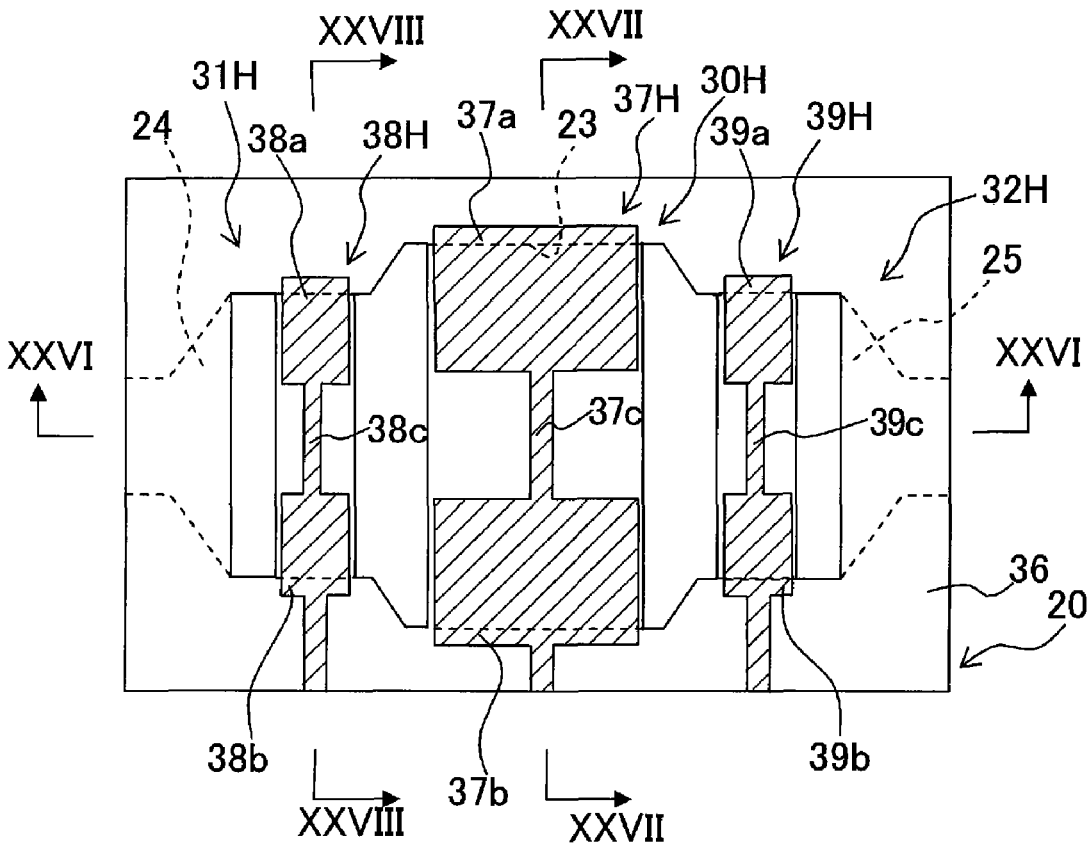
FIG. 25 shows a plan view illustrating a pump of an eighth modified embodiment.

It is not necessarily indispensable that the electrode, which is disposed on the upper surface of the piezoelectric material layer, is arranged in the area facing the central portion in the widthwise direction of the ink flow passage 22 of the pressure chamber 23 or the like. For example, as shown in FIGS. 23 and 24, electrodes 37G to 39G may be arranged in areas corresponding to one side in the flow passage widthwise direction of the upper surface of a piezoelectric material layer 36G (seventh modified embodiment). In this arrangement, when the driving electric potential is applied to the electrodes 37G to 39G, the vibration plate 35 is deformed to project toward the base member 20 on one side in the widthwise direction of the flow passage arranged with the electrodes 37G to 39G.

The piezoelectric actuator may be constructed as follows. That is, the vibration plate is deformed to project toward the side not facing the base member, when the driving electric potential is applied to the driving electrode or the flow passage-opening/closing electrode. When the vibration plate is deformed as described above, the ink supply flow passage and/or the ink discharge flow passage is opened.

For example, in the case of a pump of an eighth modified embodiment shown in FIGS. 25 to 28, three types of electrodes 37H to 39H, which are included in a pressure-applying portion 30H and opening/closing portions 31H, 32H respectively, are provided on the upper surface of the piezoelectric material layer 36. Further, each of the electrodes 37H to 39H is divided into two electrodes which are arranged at the both ends in the widthwise direction of the flow passage. That is, the driving electrode 37H is divided into the two electrodes 37*a*, 37*b* which are arranged in areas corresponding to the both ends of the pressure chamber 23 in the widthwise direction of the flow passage respectively. The flow passage-opening/closing electrode 38H is divided into the two electrodes 38*a*, 38*b* which are arranged in areas corresponding to the both ends in the widthwise direction of the flow passage of the valve seat 28H of the ink supply flow passage 24 respectively. Further, the flow passage-opening/closing electrode 39H is divided into the two electrodes 39*a*, 39*b* which are arranged in areas corresponding to the both ends in the widthwise direction of the flow passage of the valve seat 29H of the ink discharge flow passage 25 respectively. The electrodes divided into two (electrode 37*a* and electrode 37*b*, electrode 38*a* and electrode 38*b*, electrode 39*a* and electrode 39*b*) mutually make conduction by means of wirings 37*c* to 39*c* which are thinner than the divided electrodes. In other words, the same electric potential is simultaneously applied to the electrodes divided into two.

Figure 26:
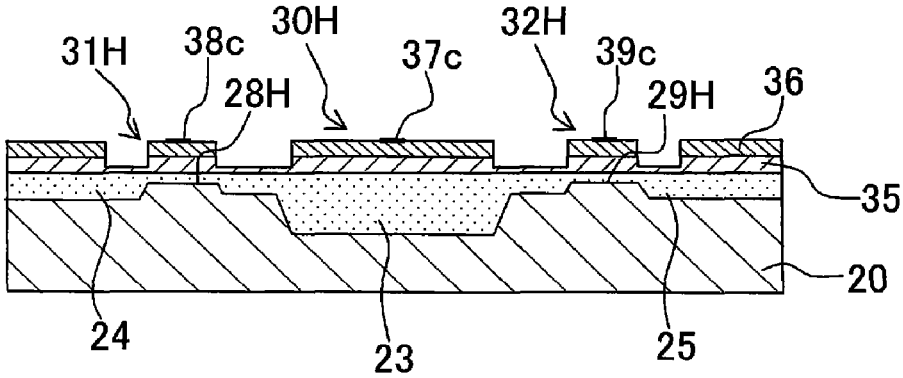
FIG. 26 shows a sectional view taken along a line XXVI-XXVI shown in FIG. 25.

On the other hand, dam-shaped valve seats 28H, 29H, which extend over the entire regions in the widthwise direction of the flow passages 24, 25, are formed for the ink supply flow passage 24 and the ink discharge flow passage 25 respectively. As shown in FIG. 26, the top surfaces (upper surfaces) of the two valve seats 28H, 29H are positioned on the same plane as that of the upper surface of the base member 20.

When the driving electric potential is applied to the divided three types of the electrodes 37H to 39H, the piezoelectric material layer 36 is shrunk in the in-plane direction in the areas corresponding to the both ends in the widthwise direction of the flow passage in which the divided electrodes are arranged. Accordingly, the vibration plate 35 is deformed to project toward the upper side (side not facing the base member 20) in the area corresponding to the central portion in the widthwise direction of the flow passage in accordance with the shrinkage of the piezoelectric material layer 36 at the both ends in the widthwise direction.

Figure 27:
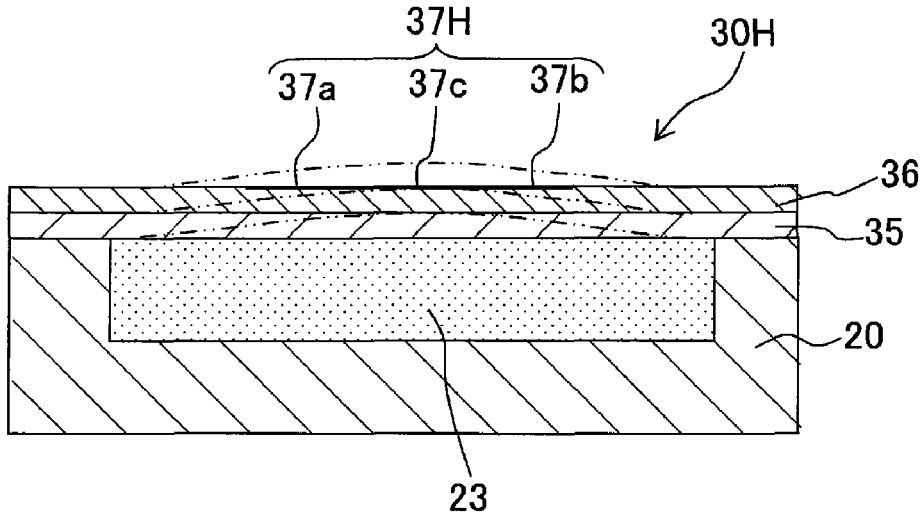
FIG. 27 shows a sectional view taken along a line XXVII-XXVII shown in FIG. 25.

Therefore, as shown by two-dot chain lines in FIG. 27, when the vibration plate 35 is deformed to project in the upward direction when the driving electric potential is applied to the driving electrode 37H at the pressure-applying portion 30H, then the volume of the pressure chamber 23 is increased. Therefore, the ink is allowed to inflow into the pressure chamber 23. After that, when the ground electric potential is applied to the driving electrode 37H, then the vibration plate 35 is returned to have the flat shape as shown by solid lines in FIG. 27, and the volume of the pressure chamber 23 is decreased. Accordingly, the pressure is applied to the ink in the pressure chamber 23.

Figure 28:
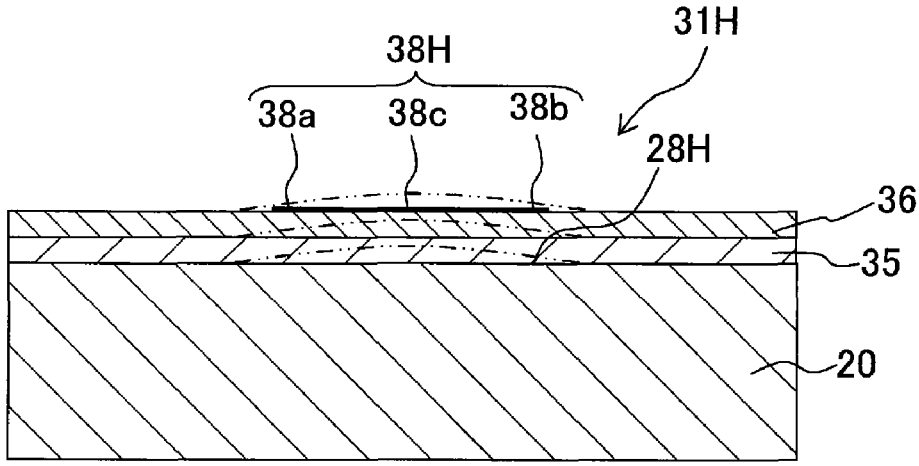
FIG. 28 shows a sectional view taken along a line XXVIII-XXVIII shown in FIG. 25.

On the other hand, when the ground electric potential (first electric potential) is applied to the flow passage-opening/closing electrode 38H at the opening/closing portion 31H corresponding to the ink supply flow passage 24, then the vibration plate 35 is in the flat state as shown by solid lines in FIG. 28, and the lower surface thereof abuts against the top surface of the dam-shaped valve seat 28H in a tight contact manner. Therefore, the ink supply flow passage 24 is closed. Starting from this state, when the driving electric potential (second electric potential) is applied to the flow passage-opening/closing electrode 38H, and the vibration plate 35 is deformed to project upwardly as shown by two-dot chain lines in FIG. 28, then the lower surface of the vibration plate 35 is separated from the top surface of the valve seat 28H. Accordingly, the gap is formed between the vibration plate 35 and the valve seat 28H. Therefore, the ink supply flow passage 24 is opened.

Similarly, when the ground electric potential is applied to the flow passage-opening/closing electrode 39H at the opening/closing portion 32H corresponding to the ink discharge flow passage 25, the ink discharge flow passage 25 is closed. On the other hand, when the driving electric potential is applied to the flow passage-opening/closing electrode 39H, then the gap is formed between the vibration plate 35 and the top surface of the valve seat 29H, and the ink discharge flow passage 25 is opened.

According to the arrangement of the eighth modified embodiment, it is enough that the top surfaces of the valve seats 28H, 29H have the flat shapes, and it is unnecessary to process the top surfaces. Therefore, the valve seats can be easily formed as compared with the valve seats 28, 29 of the embodiment described above (see FIGS. 3 and 6) in which the valve seats are formed to have the recessed forms corresponding to the projection deformation of the vibration plate.

As described above, the seventh modified embodiment has been referred to as the example of the piezoelectric actuator in which the vibration plate is deformed to project toward the side not facing the base member when the driving electric potential is applied to the driving electrode and/or the flow passage-opening/closing electrode. However, the vibration plate 35 can be deformed to project upwardly even in the case of the electrode structure of the piezoelectric actuator 21 of the embodiment described above (see FIGS. 2 to 5). However, the driving electric potential, which is applied from the driver IC 60 to the driving electrode 37 and the flow passage-opening/closing electrodes 38, 39, is a negative electric potential lower than the ground electric potential. When the negative electric potential is applied as the driving electric potential as described above, the direction of the electric field, which acts on the piezoelectric material layer 36 interposed between the upper and lower electrodes, is the direction opposite to that of the case in which the driving electric potential is positive, the direction being opposite to the direction of polarization. Accordingly, the piezoelectric material layer 36 is elongated in the in-plane direction. As a result, the vibration plate 35 is deformed to project toward the upper side (toward the side not facing the base member 20) conversely to the embodiment described above.

Figure 29:
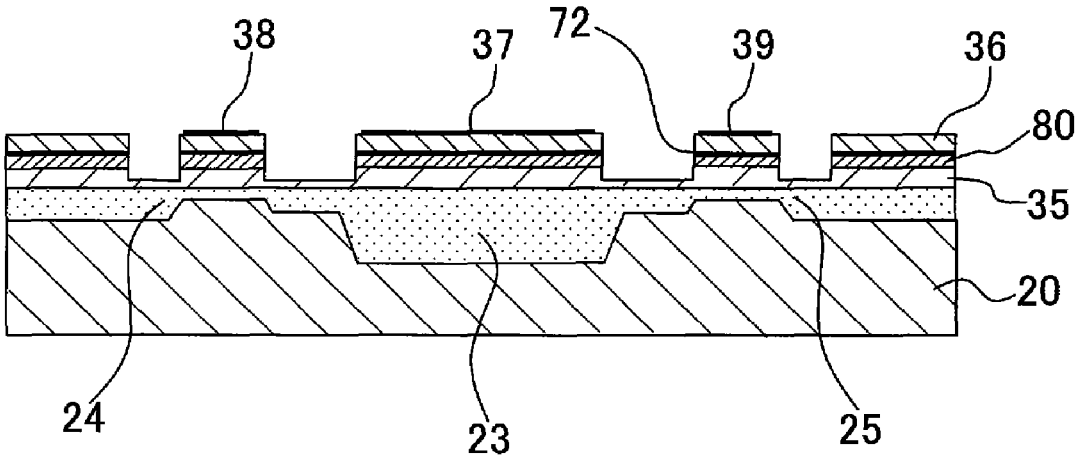
FIG. 29 shows a sectional view illustrating a pump of a ninth modified embodiment corresponding to FIG. 3.
Figure 30:
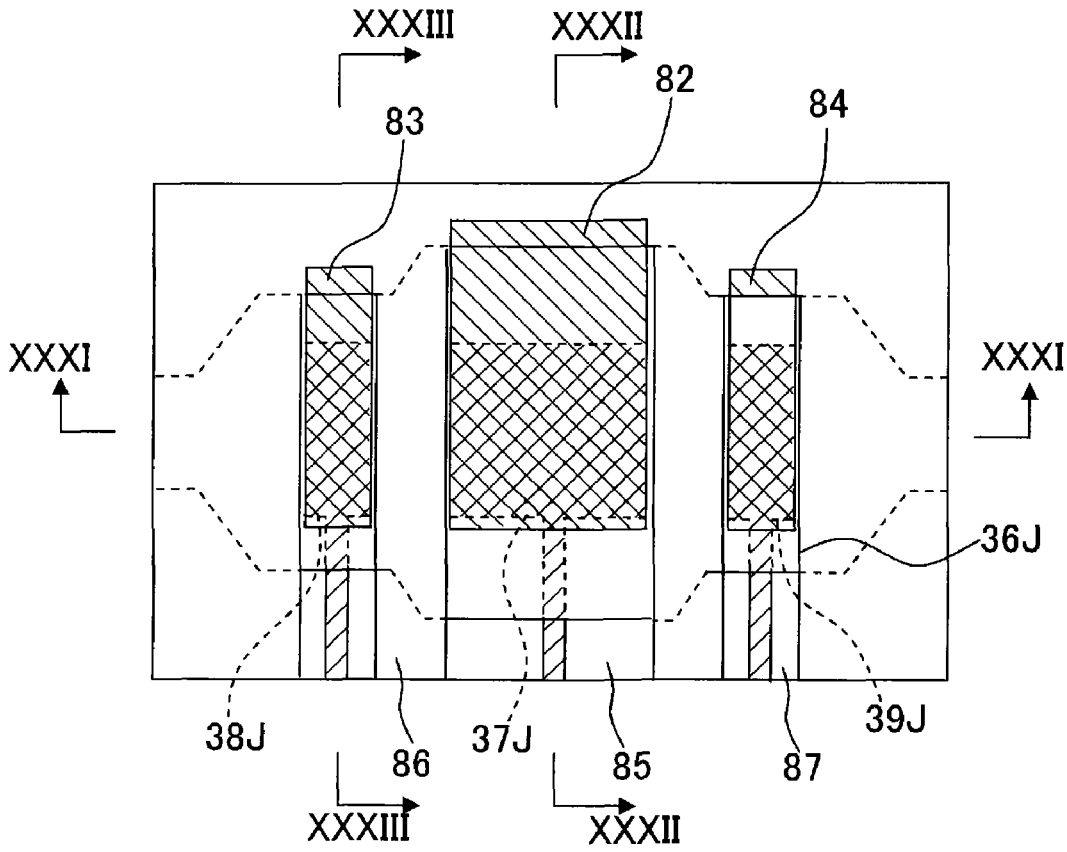
FIG. 30 shows a plan view illustrating a pump of a tenth modified embodiment.
Figure 31:
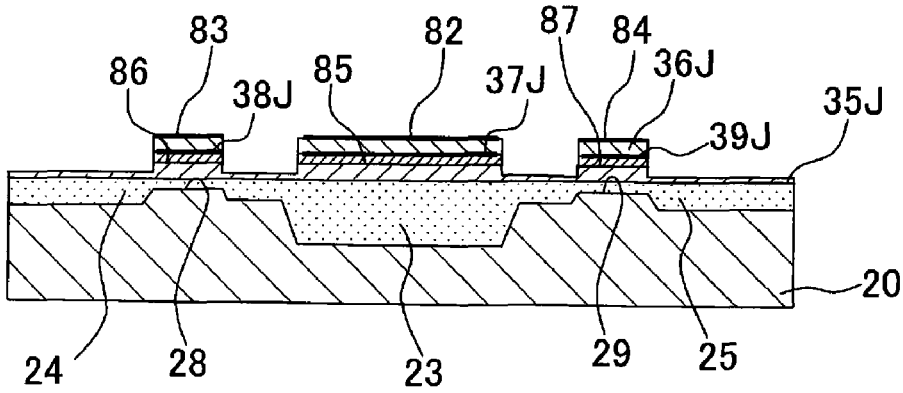
FIG. 31 shows a sectional view taken along a line XXXI-XXXI shown in FIG. 30.
Figure 32:
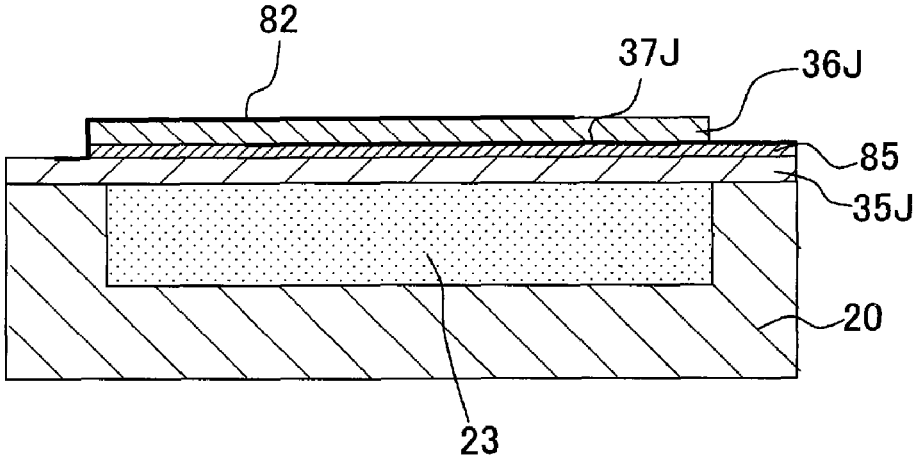
FIG. 32 shows a sectional view taken along a line XXXII-XXXII shown in FIG. 30.
Figure 33:
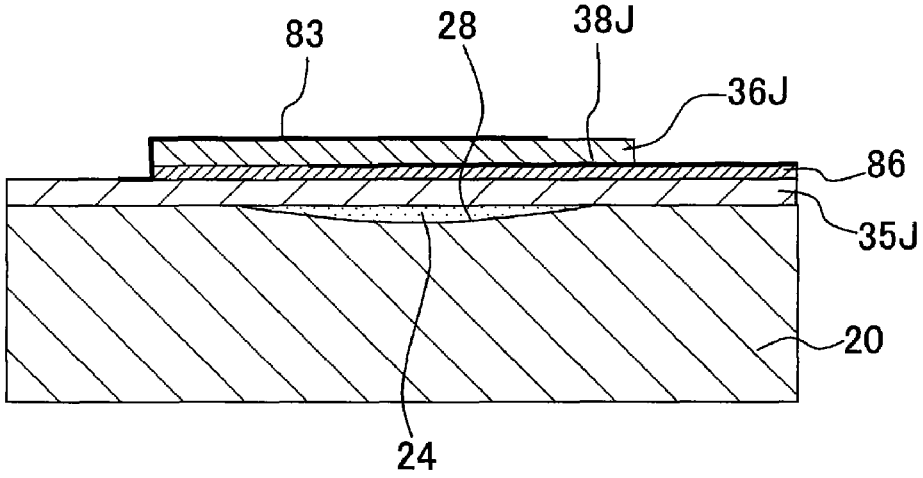
FIG. 33 shows a sectional view taken along a line XXXIII-XXXIII shown in FIG. 30.

In the embodiment described above, the vibration plate 35 is formed by the metal material having the conductivity. The upper surface of the vibration plate 35 also serves as the common electrode (third electrode) corresponding to the driving electrode 37 and the flow passage-opening/closing electrodes 38, 39. However, as shown in FIG. 29, a common electrode 72, which is retained at the ground electric potential distinctly from the vibration plate 35, may be provided on the lower surface of the piezoelectric material layer 36 (ninth modified embodiment). However, when the vibration plate 35 is formed by the conductive material, an insulating layer 80, which electrically insulates the common electrode 72 and the vibration plate 35, is provided between the common electrode 72 and the upper surface of the vibration plate 35. The insulating layer 80 can be formed of a ceramics material such as alumina and zirconia or a resin material such as polyimide. When the vibration plate 35 is formed by silicon, it is also appropriate that a silicon oxide film is formed as the insulating layer 80 on the upper surface of the vibration plate 35. On the other hand, when the vibration plate 35 is formed by an insulative material, it is unnecessary to provide the insulating layer 80.

As shown in FIGS. 30 to 33, the following arrangement is also available. That is, a driving electrode 37J (first electrode) and flow passage-opening/closing electrodes 38J, 39J (second electrodes) are arranged on the lower surface of a piezoelectric material layer 36J. Electrodes 82 to 84 (third electrodes), which face the driving electrode 37J and the flow passage-opening/closing electrodes 38J, 39J, are arranged on the upper surface of the piezoelectric material layer 36J respectively (tenth modified embodiment). Also in the tenth modified embodiment, when the vibration plate 35 is formed by a conductive material, it is necessary that an insulating layer 85, which electrically insulates the driving electrode 37J and the flow passage-opening/closing electrodes 38J, 39J and the upper surface of the vibration plate 35, is provided between the driving electrode 37J and the flow passage-opening/closing electrodes 38J, 39J and the upper surface of the vibration plate 35. However, the electrodes 82 to 84 can be retained at the ground electric potential by merely allowing the ends of the electrodes 82 to 84 to make conduction with the upper surface of the vibration plate 35 retained at the ground electric potential. On the other hand, when the vibration plate 35 is formed by an insulative material, it is unnecessary to provide the insulating layer 85. However, it is necessary to distinctly provide wirings which connect the electrodes 82 to 84 to the driver IC 60 to retain them at the ground electric potential.

Figure 36:
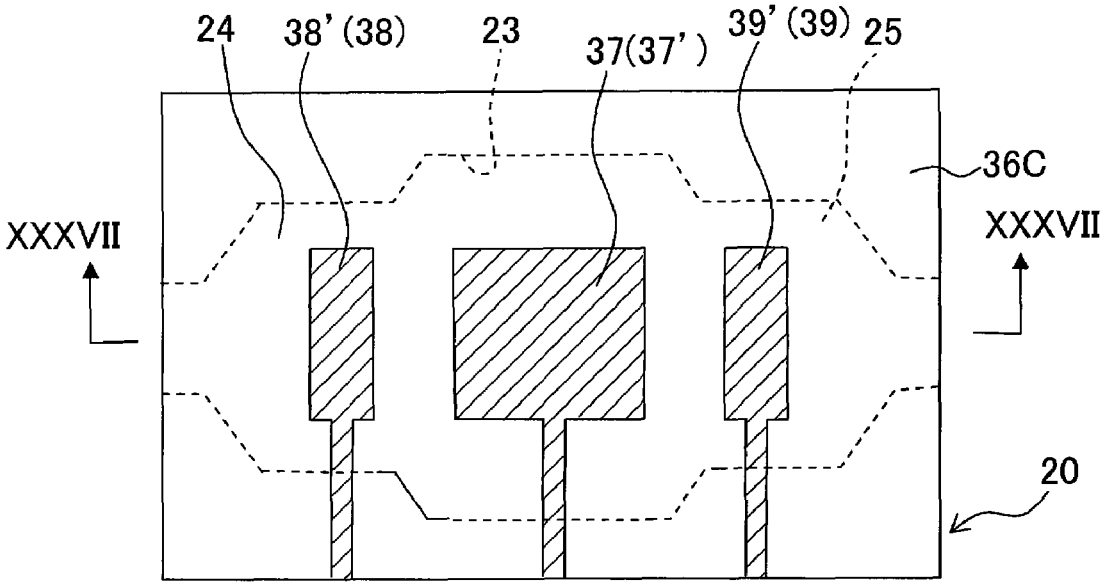
FIG. 36 shows a plan view illustrating a pump of a twelfth modified embodiment.
Figure 37:
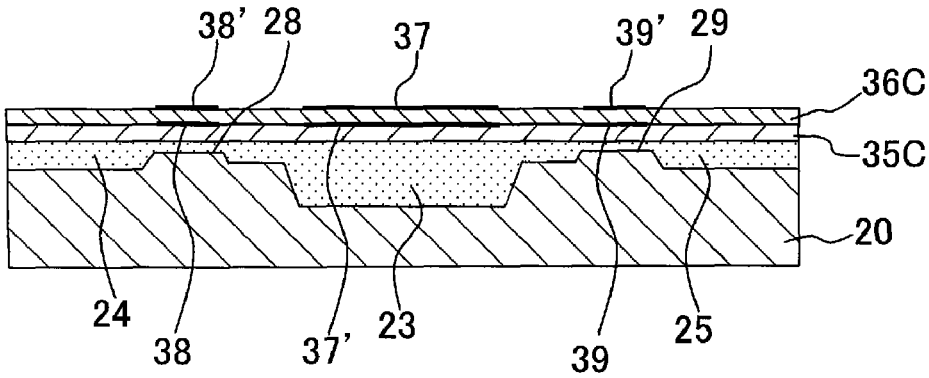
FIG. 37 shows a sectional view taken along a line XXXVII-XXXVII shown in FIG. 36.
Figure 38:
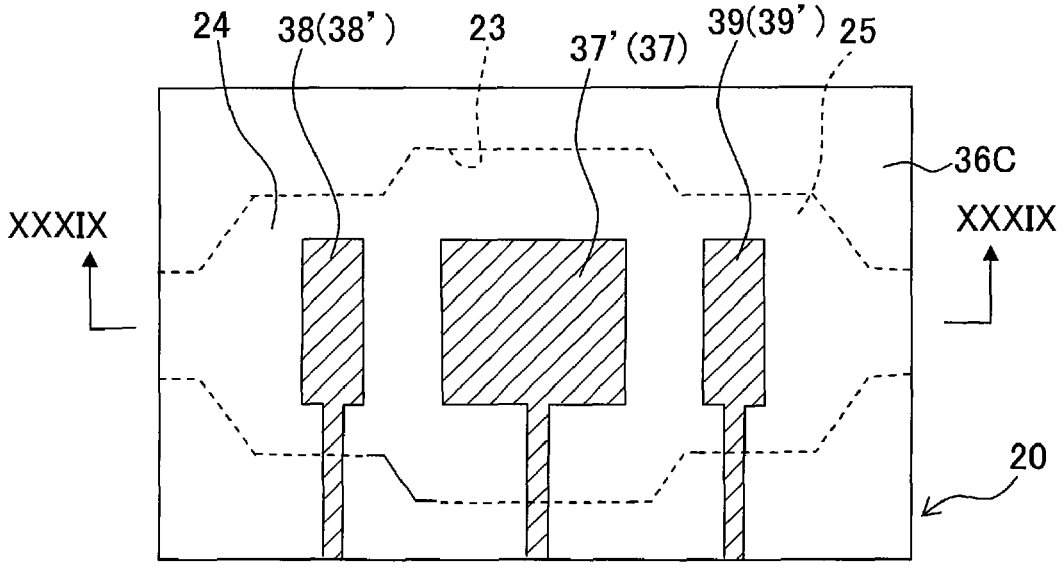
FIG. 38 shows a plan view illustrating a pump of a twelfth modified embodiment.
Figure 39:
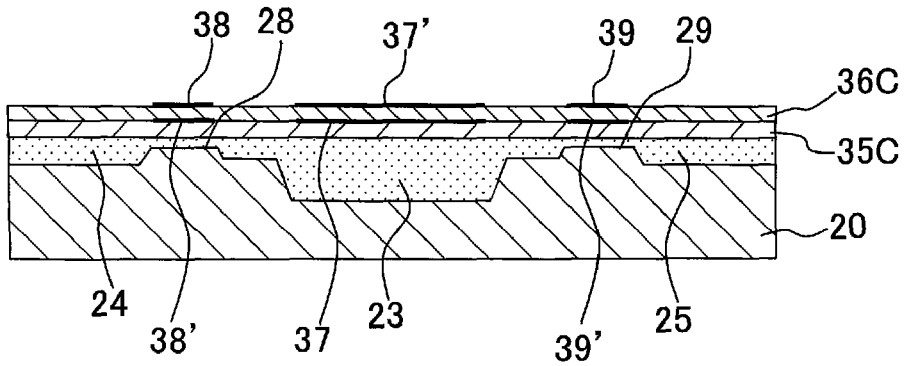
FIG. 39 shows a sectional view taken along a line XXXIX-XXXIX shown in FIG. 38.

In the embodiment and the modified embodiments thereof described above, both of the driving electrode (first electrode) and the flow passage-opening/closing electrode (second electrode) are arranged on one surface of the piezoelectric material layer, and the common electrode (third electrode) is arranged on the other surface of the piezoelectric material layer. However, the driving electrode and the flow passage-opening/closing electrodes may be arranged on different surfaces of the piezoelectric material layer respectively. For example, as shown in FIGS. 36 and 37, the driving electrode 37 may be arranged on the surface of the piezoelectric material layer 36C not facing the vibration plate 35C, and the flow passage-opening/closing electrodes 38, 39 may be arranged on the surface of the piezoelectric material layer 36C facing the vibration plate 35C. Alternatively, as shown in FIGS. 38 and 39, the driving electrode 37 may be arranged on the surface of the piezoelectric material layer 36C facing the vibration plate 35C, and the flow passage-opening/closing electrodes 38, 39 may be arranged on the surface of the piezoelectric material layer 36C not facing the vibration plate 35C. In these arrangements, the electrodes (third electrodes) 37', 38', 39', which face the driving electrode 37 and the flow passage-opening/closing electrodes 38, 39 respectively, are also arranged on the mutually different surfaces.

The shapes of the pressure chamber, the ink supply flow passage, and the ink discharge flow passage are not limited to the shapes of the embodiments described above.

Figure 34:
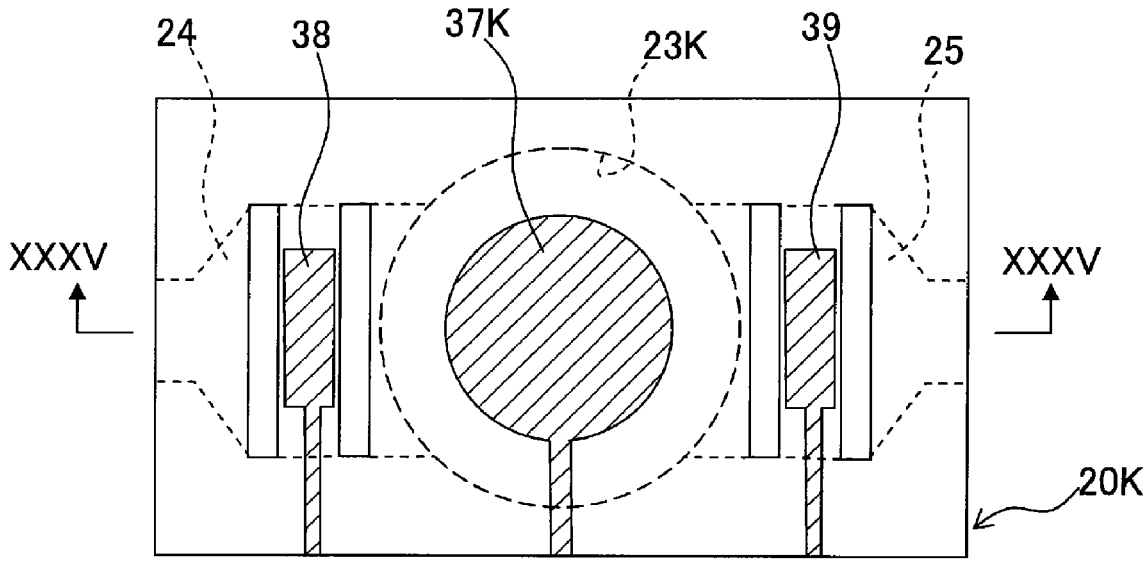
FIG. 34 shows a plan view illustrating a pump of an eleventh modified embodiment.
Figure 35:
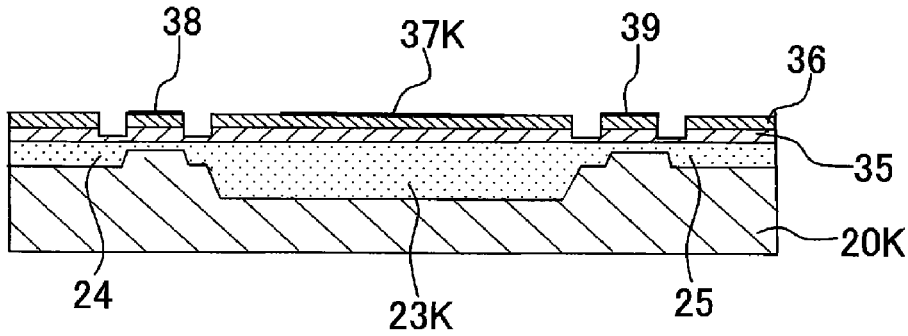
FIG. 35 shows a sectional view taken along a line XXXV-XXXV shown in FIG. 34.

For example, as shown in FIGS. 34 and 35, a pressure chamber 23K may have a planar shape of a circular shape (eleventh modified embodiment). When the pressure chamber 23K is circular, and a circular driving electrode 37K is arranged in an area corresponding to the central portion thereof, then the amount of displacement of the central portion of the vibration plate 35, i.e., the amount of volume change of the pressure chamber 23K is increased as compared with the case in which the pressure chamber is rectangular. Therefore, the pressure can be efficiently applied to the ink.

The ink supply flow passage and the ink discharge flow passage, which are positioned on the left and right sides respectively, may be formed to have asymmetrical shapes in relation to the pressure chamber. It is not especially indispensable that the ink supply flow passage, the pressure chamber, and the ink discharge flow passage are arranged on the straight line as shown in FIG. 2 as well. The ink supply flow passage and the ink discharge flow passage may be arranged in a form of being folded at the pressure chamber as viewed in a plan view.

In the embodiment and the modified embodiments described above, the vibration plate is either deformed to project toward the base member, or the vibration plate is deformed to project toward the side not facing the base member. However, the electrode may be arranged so that the deformation is effected to project in both of the direction in which the vibration plate is allowed to make approach to the base member and the direction in which the vibration plate is allowed to make separation from the base member. In this arrangement, for example, the valve seat of the base member may be formed so that the ink supply flow passage and/or the ink discharge flow passage is closed by deforming the vibration plate to project in the direction to make approach to the base member.

Figure 40:
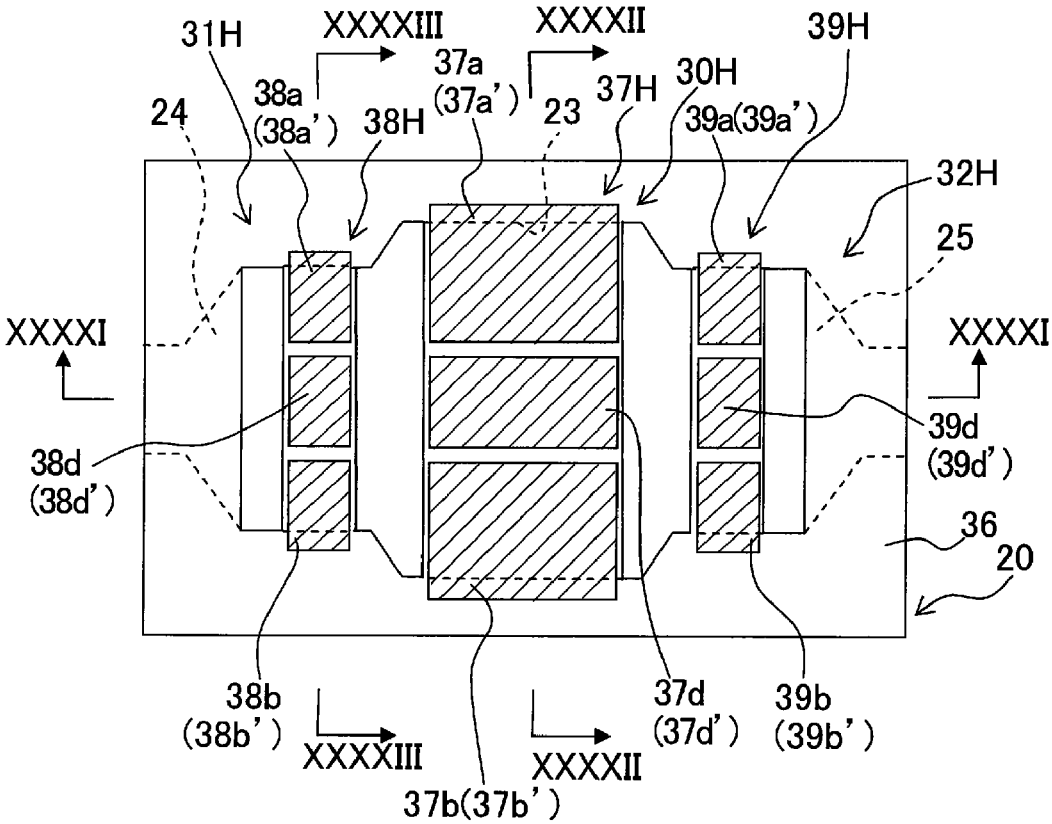
FIG. 40 shows a plan view illustrating a pump of a thirteenth modified embodiment.
Figure 41:
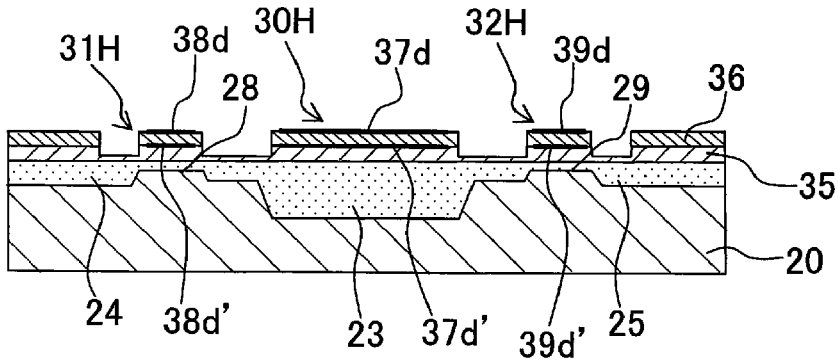
FIG. 41 shows a sectional view taken along a line XXXXI-XXXXI shown in FIG. 40.

For example, as shown in FIGS. 40 and 41, three types of electrodes 37H to 39H, which are included in a pressure-applying portion 30H and opening/closing portions 31H, 32H, are provided on the upper surface of the piezoelectric material layer 36. Further, three electrodes are arranged as each of the electrodes 37H to 39H at a central portion and both ends in the widthwise direction of the flow passage. That is, as for the driving electrode 37H, three electrodes 37*a*, 37*b*, 37*d* are arranged at the central portion and the both ends of the pressure chamber 23 in the widthwise direction of the flow passage respectively. As for the flow passage-opening/closing electrode 38H, three electrodes 38*a*, 38*b*, 38*d* are arranged at the central portion and the both ends of the valve seat 28 of the ink supply flow passage 24 in the widthwise direction of the flow passage respectively. Further, as for the flow passage-opening/closing electrode 39H, three electrodes 39*a*, 39*b*, 39*d* are arranged at the central portion and the both ends of the valve seat 29 of the ink discharge flow passage 25 in the widthwise direction of the flow passage respectively. On the other hand, electrodes 37*a*', 37*b*', 37*d*', 38*a*', 38*b*', 38*d*', 39*a*', 39*b*', 39*d*', which correspond to the respective electrodes, are arranged on the lower surface of the piezoelectric material layer 36. The electrodes disposed at the both ends in the widthwise direction of the flow passage are allowed to make conduction with each other by means of unillustrated wirings for each of the electrodes 37H to 39H. The same electric potential can be simultaneously applied to the electrodes which are in conduction. For example, as for the electrode 37H, the electrode 37*a* and the electrode 37*b* are allowed to make conduction, and the electrode 37*a*' and the electrode 37*b*' are allowed to make conduction. As for the electrode 38H, the electrode 38*a* and the electrode 38*b* are allowed to make conduction, and the electrode 38*a*' and the electrode 38*b*' are allowed to make conduction in the same manner as described above. Further, as for the electrode 39H, the electrode 39*a* and the electrode 39*b* are allowed to make conduction, and the electrode 39*a*' and the electrode 39*b*' are allowed to make conduction in the same manner as described above.

Figure 42:
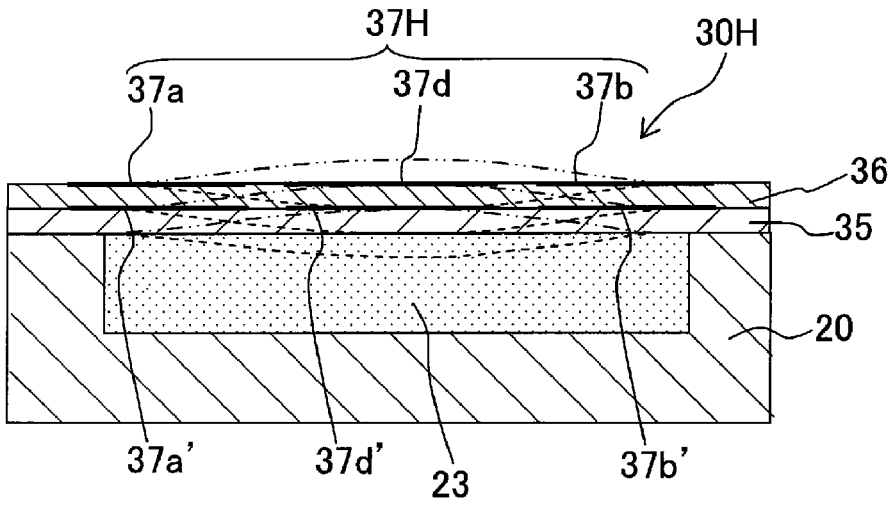
FIG. 42 shows a sectional view taken along a line XXXXII-XXXXII shown in FIG. 40.

In this state, in order that the area, which corresponds to the pressure-applying portion 30H of the vibration plate 35, is deformed to project in the direction to make separation from the base member as shown by two-dot chain lines in FIG. 42, it is appropriate that the predetermined electric potential is applied to the electrode 37*a* and the electrode 37*b*, and the other electrodes 37*d*, 37*a*', 37*b*', 37*d*' are allowed to have the ground electric potential. In this situation, the electrode 37*a* and the electrode 37*a*', and the electrode 37*b* and the electrode 37*b*' have the mutually different electric potentials at the both ends of the pressure chamber 23 in the flow passage widthwise direction respectively. On the other hand, the electrode 37*d* and the electrode 37*d*' have the same electric potential at the central portion of the pressure chamber 23 in the flow passage widthwise direction. Therefore, the piezoelectric effect is generated at the both ends of the pressure chamber 23 in the flow passage widthwise direction, and the vibration plate 35 is deformed to project in the direction to make separation from the base member.

On the other hand, in order that the area, which corresponds to the pressure-applying portion 30H of the vibration plate 35, is deformed to project in the direction to make approach to the base member as shown by dotted lines in FIG. 42, it is appropriate that the predetermined electric potential is applied to the electrodes 37*a*, 37*b*, 37*d* and the electrodes 37*a*', 37*b*', and the electrode 37*d*' is allowed to have the ground electric potential. In this situation, the electrode 37*a* and the electrode 37*a*', and the electrode 37*b* and the electrode 37*b*' have the same electric potential at the both ends of the pressure chamber 23 in the flow passage widthwise direction respectively. On the other hand, the electrode 37*d* and the electrode 37*d*' have the different electric potentials at the central portion of the pressure chamber 23 in the flow passage widthwise direction. Therefore, the piezoelectric effect is generated at the central portion of the pressure chamber 23 in the flow passage widthwise direction, and the vibration plate 35 is deformed to project in the direction to make approach to the base member.

Figure 43:
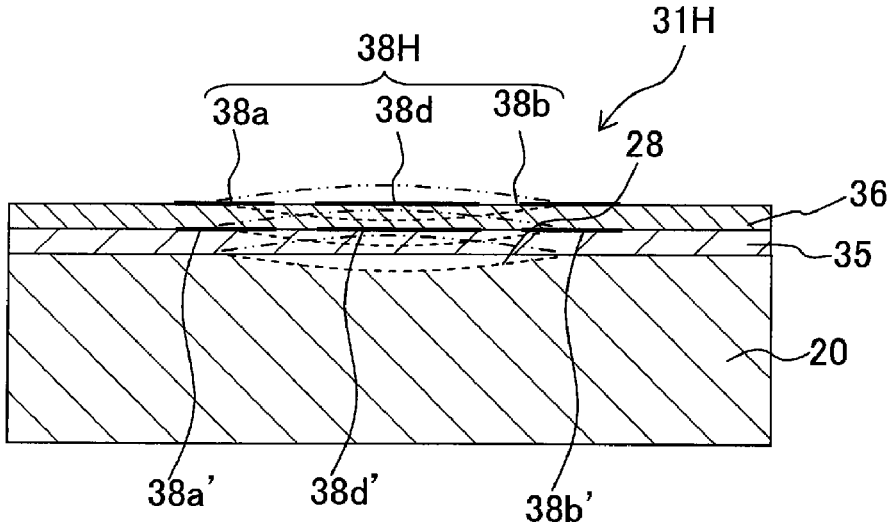
FIG. 43 shows a sectional view taken along a line XXXXIII-XXXXIII shown in FIG. 40.

The areas of the vibration plate 35 corresponding to the opening/closing portions 31H, 32H can be deformed in both of the direction to make separation from the base member (see two-dot chain lines in FIG. 43) and the direction to make approach to the base member (see dotted lines in FIG. 43) by applying the electric potentials to the respective electrodes in the same manner as the case of the area corresponding to the pressure-applying portion 30H described above.

According to this arrangement, the vibration plate can be deformed to project in both of the direction to make separation from the base member and the direction to make approach to the base member by merely switching the electric potential to be applied to each of the electrodes. Therefore, even when the same driving voltage is adopted, it is possible to secure the large amount of displacement of the vibration plate as compared with the arrangement in which the vibration plate is deformed in only any one of the direction to make separation from the base member and the direction to make approach to the base member.

In the embodiments described above, both of the flow passage width and the flow passage depth of the pressure chamber are greater than those of the ink supply flow passage and the ink discharge flow passage in order that the flow passage cross-sectional area of the pressure chamber is greater than the flow passage cross-sectional areas of the ink supply flow passage and the ink discharge flow passage. However, only one of the flow passage width and the flow passage depth of the pressure chamber may be greater than those of the ink supply flow passage and the ink discharge flow passage. When the flow passage width is increased, the area of the vibration plate facing the pressure chamber has a widened areal size. Therefore, this arrangement is preferred in that the volume change of the pressure chamber can be increased upon the deformation of the vibration plate.

In the embodiments described above, the piezoelectric actuator is provided with the two opening/closing portions for opening and closing the ink supply flow passage and the ink discharge flow passage respectively. However, any one of the two opening/closing portions may be omitted. Even in this arrangement, when the pressure of the ink in the pressure chamber is fluctuated, then one of the ink supply flow passage and the ink discharge flow passage is closed by the opening/closing portion, and thus the escape of the pressure wave from the pressure chamber can be avoided to some extent. Therefore, the pressure can be efficiently applied to the ink in the pressure chamber. A check valve, which is operated when the pressure on the downstream side is higher than the pressure on the upstream side to avoid any counter flow, may be provided in the flow passage from which the opening/closing portion is omitted.

Further, the base member may be formed with the pressure chamber and three of more flow passages communicated with the pressure chamber. The piezoelectric actuator may be provided with three or more opening/closing portions for opening/closing the three or more communicated flow passages respectively.

Figure 44:
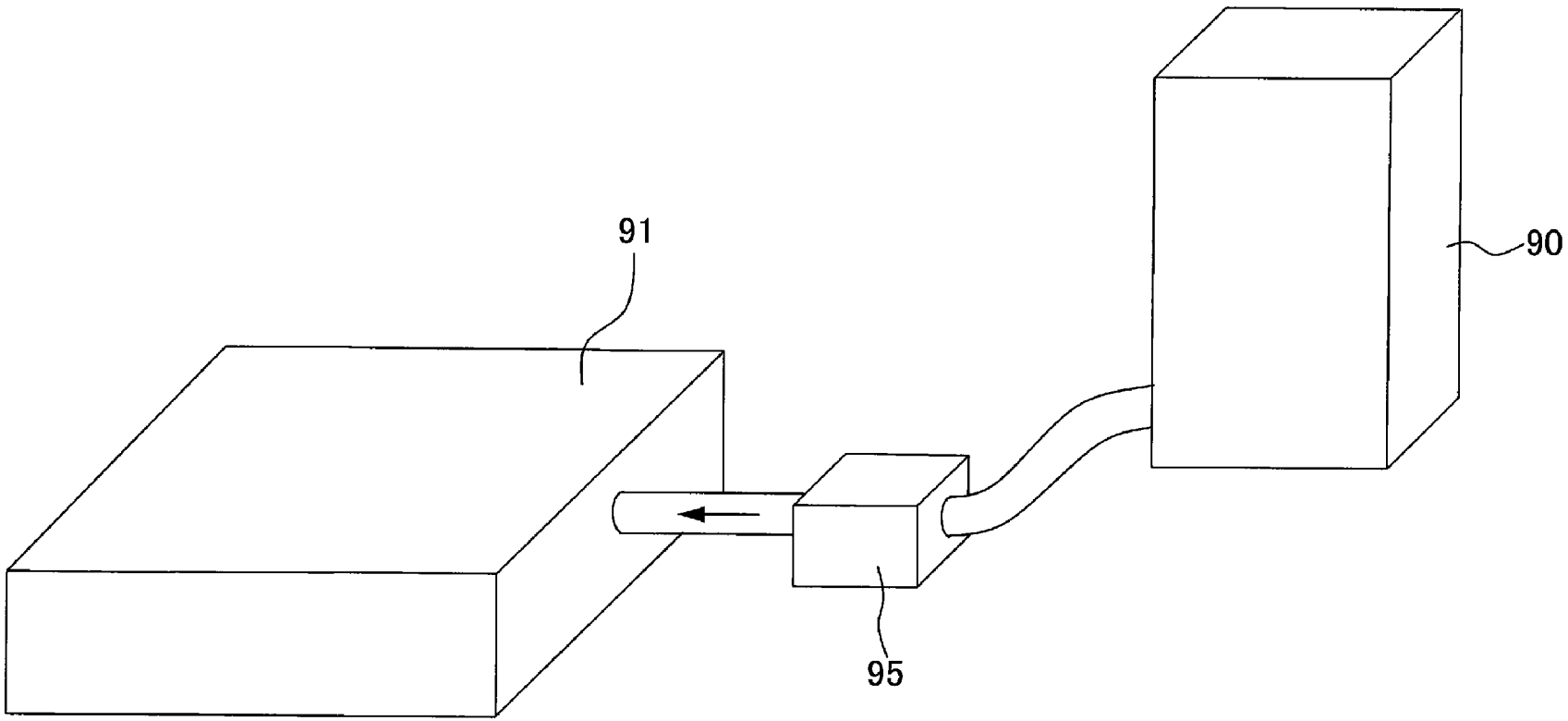
FIG. 44 shows an example in which the present invention is applied to a pump for transporting liquid fuel to a fuel cell.

The present invention has been explained above as exemplified by the case as the embodiment in which the present invention is applied to the ink supply pump of the ink-jet printer. However, the form, to which the present invention is applicable, is not limited thereto. For example, as shown in FIG. 44, the present invention is applicable to a pump 95 which is provided between a fuel cartridge 90 for storing the liquid fuel such as methanol and a fuel cell 91 which consumes the liquid fuel to generate the electric power and which transports the liquid fuel to the fuel cell. Other than the above, the present invention is also applicable to a liquid transport apparatus for transporting a liquid such as a reagent solution and/or a biochemical solution in a micro total analysis system (μTAS), and a liquid transport apparatus for transporting a liquid such as a solvent and/or a chemical solution in a micro chemical system.

What is claimed is:

1. A liquid transport apparatus comprising:

a base member having a surface in which a pressure chamber and a liquid flow passage are formed, the liquid flow passage being communicated with the pressure chamber and having a flow passage cross-sectional area smaller than that of the pressure chamber; and a piezoelectric actuator having a pressure-applying portion which applies a pressure to a liquid in the pressure chamber and an opening/closing portion which opens and closes the liquid flow passage, the piezoelectric actuator being formed of a stack including:

a vibration plate which is arranged on the surface of the base member and which covers both the pressure chamber and the liquid flow passage;

a piezoelectric material layer which is arranged on a surface, of the vibration plate, on a side not facing the base member;

a first electrode which is arranged, on one of surfaces of the piezoelectric material layer, at an area thereof corresponding to the pressure chamber;

a second electrode which is arranged, on one of the surfaces of the piezoelectric material layer, at an area thereof corresponding to the liquid flow passage; and a third electrode which is arranged on the piezoelectric material layer to face the first electrode and the second electrode, wherein the pressure-applying portion faces the pressure chamber, the opening/closing portion faces the liquid flow passage, and the pressure-applying portion and the opening/closing portion are arranged along the surface of the base member, wherein a low rigidity portion, at which rigidity of the stack is lower locally, is provided between the pressure-applying portion and the opening/closing portion, and wherein the low rigidity portion is a recess formed in the vibration plate at an area thereof facing a boundary between the pressure chamber and the liquid flow passage.

2. The liquid transport apparatus according to claim 1, wherein the recess is formed on the surface, of the vibration plate, on the side not facing the base member.

3. The liquid transport apparatus according to claim 1, wherein a flow passage width of the pressure chamber is greater than a flow passage width of the liquid flow passage.

4. The liquid transport apparatus according to claim 1, further comprising a driver which is connected to the first electrode and the second electrode via independent wirings respectively, wherein the driver independently drives the pressure-applying portion and the opening/closing portion by applying a predetermined electric potential to each of the first electrode and the second electrode at a predetermined timing.

5. The liquid transport apparatus according to claim 1, wherein the first electrode and the second electrode are arranged on one of the surfaces of the piezoelectric material layer, and the third electrode is arranged on the other of the surfaces of the piezoelectric material layer.

6. The liquid transport apparatus according to claim 1, wherein in the piezoelectric actuator, the opening/closing portion includes first and second opening/closing portions; the first opening/closing portion opens and closes an upstream portion of the liquid flow passage located at an upstream side in a liquid transport direction with respect to the pressure chamber and the second opening/closing portion opens and closes a downstream portion of the liquid flow passage located at a downstream side in the liquid transport direction with respect to the pressure chamber.

7. A liquid transport apparatus comprising:

a base member having a surface in which a pressure chamber and a liquid flow passage are formed, the liquid flow passage being communicated with the pressure chamber and having a flow passage cross-sectional area smaller than that of the pressure chamber;

a piezoelectric actuator having a pressure-applying portion which applies a pressure to a liquid in the pressure chamber and an opening/closing portion which opens and closes the liquid flow passage, the piezoelectric actuator being formed of a stack including:

a vibration plate which is arranged on the surface of the base member and which covers both the pressure chamber and the liquid flow passage;

a piezoelectric material layer which is arranged on a surface, of the vibration plate, on a side not facing the base member;

a first electrode which is arranged, on one of surfaces of the piezoelectric material layer, at an area thereof corresponding to the pressure chamber;

a second electrode which is arranged, on one of the surfaces of the piezoelectric material layer, at an area thereof corresponding to the liquid flow passage; and a third electrode which is arranged on the piezoelectric material layer to face the first electrode and the second electrode, wherein the pressure-applying portion faces the pressure chamber, the opening/closing portion faces the liquid flow passage, and the pressure-applying portion and the opening/closing portion are arranged along the surface of the base member; and a driver which is connected to the first electrode and the second electrode via independent wirings respectively, wherein the driver independently drives the pressure-applying portion and the opening/closing portion by applying a predetermined electric potential to each of the first electrode and the second electrode at a predetermined timing, wherein the predetermined electric potential includes first and second predetermined electric potentials which are mutually different; when the first predetermined electric potential is applied from the driver to the second electrode, the vibration plate is parallel to the surface of the base member at the opening/closing portion, and when the second predetermined electric potential is applied to the second electrode, the vibration plate is deformed to project toward the base member at the opening/closing portion; and a recessed valve seat, which is adapted to projection deformation of the vibration plate toward the base member, is formed in the liquid flow passage of the base member, and when the vibration plate is deformed to project toward the base member to abut against the recessed valve seat, the liquid flow passage is closed.

8. The liquid transport apparatus according to claim 7, wherein the second electrode is arranged, on the surface of the piezoelectric layer disposed on a side not facing the base member, at an area thereof facing a central portion in a widthwise direction of the liquid flow passage.

9. A liquid transport apparatus comprising:

a base member having a surface in which a pressure chamber and a liquid flow passage are formed, the liquid flow passage being communicated with the pressure chamber and having a flow passage cross-sectional area smaller than that of the pressure chamber;

a piezoelectric actuator having a pressure-applying portion which applies a pressure to a liquid in the pressure chamber and an opening/closing portion which opens and closes the liquid flow passage, the piezoelectric actuator being formed of a stack including:

a vibration plate which is arranged on the surface of the base member and which covers both the pressure chamber and the liquid flow passage;

a piezoelectric material layer which is arranged on a surface, of the vibration plate, on a side not facing the base member;

a first electrode which is arranged, on one of surfaces of the piezoelectric material layer, at an area thereof corresponding to the pressure chamber;

a second electrode which is arranged, on one of the surfaces of the piezoelectric material layer, at an area thereof corresponding to the liquid flow passage; and a third electrode which is arranged on the piezoelectric material layer to face the first electrode and the second electrode, wherein the pressure-applying portion faces the pressure chamber, the opening/closing portion faces the liquid flow passage, and the pressure-applying portion and the opening/closing portion are arranged along the surface of the base member; and a driver which is connected to the first electrode and the second electrode via independent wirings respectively, wherein the driver independently drives the pressure-applying portion and the opening/closing portion by applying a predetermined electric potential to each of the first electrode and the second electrode at a predetermined timing, wherein the predetermined electric potential includes first and second predetermined electric potentials which are mutually different; when the first predetermined electric potential is applied from the driver to the second electrode, the vibration plate is parallel to the surface of the base member at the opening/closing portion, and when the second predetermined electric potential is applied to the second electrode, the vibration plate is deformed to project toward a side not facing the base member at the opening/closing portion; and the liquid flow passage of the base member has a dam-shaped valve seat, which extends entirely over the liquid flow passage in a widthwise direction and which has a top surface positioned in a plane same as that of the surface of the base member, and when the vibration plate is deformed to project toward the side not facing the base member, a gap is formed between the vibration plate and the top surface of the valve seat to open the liquid flow passage.

10. The liquid transport apparatus according to claim 9, wherein the second electrode includes two second-electrode portions arranged, on the surface of the piezoelectric material layer on the side not facing the base member, at areas thereof respectively, the areas facing both ends in a widthwise direction of the liquid flow passage respectively.

11. A method for producing a liquid transport apparatus, comprising:

forming, on a surface of a base member, a pressure chamber, and a liquid flow passage which is communicated with the pressure chamber and which has a flow passage cross-sectional area smaller than that of the pressure chamber; and producing a piezoelectric actuator arranged on the surface of the base member and including a pressure-applying portion which applies a pressure to a liquid in the pressure chamber, and an opening/closing portion which opens and closes the liquid flow passages, wherein, the production of the piezoelectric actuator includes:

forming a piezoelectric material layer on a side of a vibration plate, not facing the base member, the vibration plate being joined to the surface of the base member to cover both the pressure chamber and the liquid flow passage;

arranging, on a surface of the piezoelectric material layer, a first electrode and a second electrode at areas thereof respectively, the surface facing the pressure chamber and the liquid flow passage, wherein the formation of the piezoelectric material layer includes depositing particles of a piezoelectric material to simultaneously form the piezoelectric material layer, of the pressure-applying portion, facing the pressure chamber and the piezoelectric material layer, of the opening/closing portion, facing the liquid flow passage; and forming a low rigidity portion comprising a recess, at which rigidity of the piezoelectric actuator is lower locally, between the pressure applying portion and the opening/closing portion and in an area of the vibration plate facing a boundary between the pressure chamber and the liquid flow passage.

12. The method for producing the liquid transport apparatus according to claim 11, further comprising joining the base member and the piezoelectric actuator.

13. The method for producing the liquid transport apparatus according to claim 12, wherein the vibration plate is conductive.

14. The method for producing the liquid transport apparatus according to claim 11, wherein the production of the piezoelectric actuator includes, before forming the piezoelectric material layer, arranging a third electrode on a surface of the vibration plate, on the side not facing the base member so that the third electrode corresponds to the pressure chamber and the liquid flow passage.

* * * * *